US012031794B2

(12) United States Patent
Coggins

(10) Patent No.: US 12,031,794 B2
(45) Date of Patent: Jul. 9, 2024

(54) MAGAZINE BASE PLATE ASSEMBLY

(71) Applicant: John A. Coggins, Carrollton, VA (US)

(72) Inventor: John A. Coggins, Carrollton, VA (US)

( * ) Notice: Subject to any disclaimer, the term of this patent is extended or adjusted under 35 U.S.C. 154(b) by 211 days.

(21) Appl. No.: 17/411,267

(22) Filed: Aug. 25, 2021

(65) Prior Publication Data

US 2021/0381787 A1 Dec. 9, 2021

Related U.S. Application Data

(63) Continuation-in-part of application No. 16/648,064, filed as application No. PCT/US2019/065250 on Dec. 9, 2019, now Pat. No. 11,131,517.

(60) Provisional application No. 62/777,750, filed on Dec. 10, 2018.

(51) Int. Cl.
*F41A 9/66* (2006.01)

(52) U.S. Cl.
CPC ..... *F41A 9/66* (2013.01)

(58) Field of Classification Search
CPC ..... F41A 9/65; F41A 9/66; F41A 9/67; F41A 9/71
See application file for complete search history.

(56) References Cited

U.S. PATENT DOCUMENTS 3,443,334 A * 5/1969 Ardolino ..... F41A 9/70 42/50
4,472,900 A * 9/1984 Howard ..... F41A 9/65 42/50
5,081,778 A * 1/1992 Switzer ..... F41A 9/66 42/50
5,113,605 A * 5/1992 Kim ..... F41A 9/71 42/50
5,450,683 A * 9/1995 Miller, IV ..... F41A 9/65 42/50
10,527,374 B1 * 1/2020 August ..... F41A 9/66
10,648,753 B1 * 5/2020 Jarratt ..... F41A 9/66
11,168,954 B1 * 11/2021 Spykerman ..... F41A 9/71
2005/0011097 A1 * 1/2005 Freed ..... F41A 9/65 42/49.02
2013/0255125 A1 * 10/2013 Bath ..... F41A 9/70 42/50
2015/0096214 A1 * 4/2015 Jones, III ..... F41A 9/71 42/49.01
2016/0370138 A1 * 12/2016 Zamm ..... F41A 9/66
2017/0321979 A1 * 11/2017 Szczepkowski ..... F41A 9/71
(Continued)

*Primary Examiner* — Gabriel J. Klein
(74) *Attorney, Agent, or Firm* — Shaddock Law Group, PC

(57) ABSTRACT

A magazine base plate assembly including a base plate having a base plate passage defined therein and a base plate aperture formed therethrough; a base plate insert adapted to be slidably positioned within at least a portion of the base plate passage and repeatably slidable between a retracted position and an extended position within the base plate passage, wherein the base plate insert aperture extends through a portion of the base plate insert; and an insert release button, wherein a portion of the insert release button is positioned through the base plate insert aperture and wherein the insert release button is repeatably slidable between an engaged position and a disengaged position, wherein in the retracted position and the engaged position at least a portion of the insert release button extends through the base plate insert aperture and into at least a portion of the base plate aperture.

20 Claims, 23 Drawing Sheets

(56) References Cited

U.S. PATENT DOCUMENTS

| | | | | |
|---|---|---|---|---|
| 2019/0226778 | A1* | 7/2019 | Cross | F41A 9/63 |
| 2020/0103189 | A1* | 4/2020 | Cass | F41A 9/65 |

* cited by examiner

MAGAZINE BASE PLATE ASSEMBLY

CROSS-REFERENCE TO RELATED APPLICATIONS

This patent application is a continuation in part of U.S. patent application Ser. No. 16/648,064, filed Mar. 17, 2020, which is a 371 of PCT/US19/65250, filed Dec. 9, 2019, which claims the benefit of U.S. Patent Application Ser. No. 62/777,750, filed Dec. 10, 2018, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of cartridge magazines. More specifically, the presently disclosed systems, methods, and/or apparatuses relate to a device for facilitating the loading process of cartridges or rounds into a magazine, adaptable to be used with a handgun, rifle, firearm, or other magazine.

2. Description of Related Art

It is generally known to form cartridge magazines of metal, plastic, or a combination of metal and plastic.

While shooting a firearm, many users have come across the problem of loading cartridges or rounds into the firearm magazines. Loading or reloading firearm magazines can be very time consuming. In addition, loading the last of the cartridges or rounds into the magazine can be difficult and may require a large amount of force to overcome the spring bias of the magazine spring and input each cartridge or round into the magazine.

There are devices intended to aid in loading cartridge magazines, each of these devices comprise devices separate from the magazine, which operates from the top of the magazine to aid in compression of the magazine spring. Current devices exert downward force on the magazine spring to allow cartridges or rounds be placed in a void created between the magazine follower or uppermost cartridge or round in the magazine. Alternatively, there are devices in which cartridges or rounds are loaded into the device and then loaded into the magazine all at once.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, known magazine loading devices have various shortcomings. For example, each of these devices operates from the top of the magazine and operate to compress the magazine spring. This not only requires compression of the magazine spring, but also requires the user to utilize a separate device that is not attached or coupled to the magazine.

Unfortunately, there is no current design that efficiently reduces the amount of spring bias provided by the magazine spring, to allow the magazine to be more easily loaded or reloaded. These and other disadvantages of the prior art are overcome with the presently disclosed magazine base plate assembly, which is operable to reduce the amount of spring bias provided by the magazine spring, to allow the magazine to be more easily loaded or reloaded. Additionally, the magazine base plate assembly is operable to quickly restore the original amount of spring bias provided by the magazine spring.

In various exemplary, nonlimiting embodiments, the present disclosure is directed to an assembly that allows for easier and faster reloading of a firearm magazine. The magazine base plate assembly opens on the bottom of the magazine so that at least a degree of spring tension of the magazine spring can be released. The spring tension is released for reloading to be done with less force. When finished reloading the magazine base plate assembly can force the magazine spring back into the firearm magazine, restoring the original degree of spring tension of the magazine spring. The present disclosure can be used in connection with any type of firearm or other magazine and will decrease the amount of force and time needed to reload the magazine.

These advantages of the present disclosure are preferably attained by providing a variety of magazine base plate assembly configurations.

The present disclosure allows the firearm magazine to at least partially release the magazine spring from the magazine, which in turn releases at least a portion of the tension while loading the magazine. When finished loading, the magazine spring is forced back into the magazine to provide the originally intended tension.

The present disclosure is a mechanical device that can replace a typical base plate of a firearm magazine. The disclosure includes a base plate for at least a portion of the magazine spring within the magazine. It can be described as a magazine for the magazine spring within the magazine.

The magazine base plate assembly of the present disclosure achieves the above-mentioned objectives through the employment of a magazine base plate assembly, which are characterized by comprising a magazine body having a magazine top end and a magazine bottom end and a magazine cavity extending from the magazine top end to the magazine bottom end; a magazine spring having a spring top end and a spring bottom end, wherein the magazine spring contacts at least a portion of a magazine follower at the spring top end, and wherein the magazine spring contact at least a portion of a magazine lock plate at the spring bottom end; a base plate releasably attached or coupled to the magazine bottom end of the magazine body, wherein the base plate a base plate body having a base plate passage defined by opposing interior side walls, and wherein each of the opposing interior side walls includes an opposing channel formed at least partially therein, and a base plate insert adapted to be slidably positioned within the base plate passage of the base plate body wherein the base plate insert is slidably positionable between a retracted position and an extended position within at least a portion of the base plate passage, wherein the base plate insert comprises opposing side walls and an internal insert chamber, wherein the opposing side walls comprise spaced side openings connected by an open channel to form a flexible tab, wherein the flexible tab comprises at least one extending tab extending from an upper portion of the flexible tab for interacting with at least one of the opposing channels to maintain the base plate insert in a retracted position, and wherein a degree of tension provided by the magazine spring is reduced when the base plate insert is in the extended position.

In various exemplary, non-limiting embodiments, the base plate insert comprises at least one downwardly mounted support wall in the base plate insert internal insert chamber to prevent the flexible tabs from overextending into the internal insert chamber.

In various exemplary, non-limiting embodiments, the magazine base plate assembly of the present disclosure comprises a base plate having a base plate body extending from a base plate upper end to a base plate lower end, wherein the base plate body includes opposing interior side walls at least partially defining a base plate passage extending through the base plate from the base plate upper end through the base plate lower end, wherein at least one inwardly extending projection extends, proximate the base plate lower end, into at least a portion of the base plate passage, and wherein at least one opposing channel is formed within each of the opposing interior side walls; and a base plate insert extending from an insert upper end to an insert lower end and having opposing side walls and opposing end walls, one or more outwardly extending projections extending from at least a portion of the insert upper end, away from each adjacent opposing end wall, wherein an internal insert chamber is formed within a portion of the base plate insert, extending from the insert lower end, toward the insert upper end, wherein a flexible tab is formed in a portion of each of the opposing side walls, wherein each flexible tab is at least partially defined between one or more spaced side openings and an open channel, wherein each flexible tab can be urged such that at least a portion of each flexible tab may be urged toward the internal insert chamber, wherein each flexible tab includes one or more extending tabs, each of which extends from a portion of each flexible tab, wherein the base plate insert is slidably positioned within at least a portion of the base plate passage and is slidable between a retracted position and an extended position within at least a portion of the base plate passage, wherein in the retracted position one or more of the extending tabs extend into at least a portion of each of the opposing channels, and wherein if each of the flexible tabs is urged a sufficient distance toward the internal insert chamber, each of the extending tabs is withdrawn from the opposing channels to allow the base plate insert to move toward the extended position.

In various exemplary, non-limiting embodiments, the base plate is removably attachable to a magazine body, via interaction between at least one protruding edge of the magazine body and one or more magazine attachment channels formed within opposing interior side walls of the base plate.

In various exemplary, non-limiting embodiments, one or more securing tabs and/or securing recesses are formed within at least a portion of the one or more magazine attachment channels so as to interact with at least a portion of the protruding edge to further secure the base plate to the magazine body.

In various exemplary, non-limiting embodiments, the base plate slidably engages the magazine body proximate a magazine bottom end.

In various exemplary, non-limiting embodiments, the magazine attachment channels are formed on the opposing interior side walls proximate the base plate upper end of the base plate body.

In various exemplary, non-limiting embodiments, the opposing channels each comprise an elongate channel formed along a portion of each opposing interior side wall.

In various exemplary, non-limiting embodiments, the base plate insert further comprises a lock plate recess in the insert upper end.

In various exemplary, non-limiting embodiments, one or more support walls extend from a top wall of the internal insert chamber into at least a portion of the internal insert chamber, wherein the support walls, wherein the support walls are formed to limit movement of the flexible tabs relative to the internal insert chamber.

In various exemplary, non-limiting embodiments, a saddleback recess is formed in each of the opposing side walls.

In various exemplary, non-limiting embodiments, the spaced apart side openings and the at least one open channel are formed so as to extend through each of the opposing side walls, wherein the open channel connects the spaced side openings on each discrete opposing side wall.

In various exemplary, non-limiting embodiments, each of the extending tabs extends from an upper portion of each flexible tab.

In various exemplary, non-limiting embodiments, each flexible tab includes a ramp portion extending to a shoulder.

In various exemplary, non-limiting embodiments, if the base plate insert is in the extended position, a degree of tension provided by a magazine spring to a magazine is reduced.

In various exemplary, non-limiting embodiments, interaction between the one or more outwardly extending projections and the one or more inwardly extending projections maintains the base plate insert within the base plate passage.

In various exemplary, non-limiting embodiments, the magazine base plate assembly of the present disclosure comprises a base plate having opposing interior side walls at least partially defining a base plate passage extending through the base plate, and wherein at least one opposing channel is formed within each of the opposing interior side walls; and a base plate insert having opposing side walls and opposing end walls, wherein an internal insert chamber is formed within a portion of the base plate insert, wherein a flexible tab is formed in a portion of each of the opposing side walls, wherein each flexible tab can be urged such that at least a portion of each flexible tab may be urged toward the internal insert chamber, wherein each flexible tab includes one or more extending tabs, each of which extends from a portion of each flexible tab, wherein the base plate insert is slidably positioned within at least a portion of the base plate passage and is slidable between a retracted position and an extended position within at least a portion of the base plate passage, wherein in the retracted position one or more of the extending tabs extend into at least a portion of each of the opposing channels, and wherein if each of the flexible tabs is urged a sufficient distance toward the internal insert chamber, each of the extending tabs is withdrawn from the opposing channels to allow the base plate insert to move toward the extended position.

In various exemplary, non-limiting embodiments, each flexible tab is at least partially defined between one or more spaced side openings and an open channel.

In various exemplary, non-limiting embodiments, the magazine base plate assembly of the present disclosure comprises a magazine body having a first upper end and a second lower end, and an internal channel extending from the first upper end to the second lower end. The assembly further includes a spring which has a movable cartridge bed at the first end of the spring and a spring base at the second end of the spring. The base is releasably connected to the second end of the magazine body. The base includes a base plate and an internal sliding release guide. The sliding release guide is adapted to be slidably connected to the interior chamber of the base plate in an activated or deactivated position. The sliding release guide includes flexible tabs which allows the sliding release guide to move within the cover from an activated, i.e., high spring tension, state to a deactivated, i.e., low spring tension, state. In the deactivated state, the spring tension in the magazine assembly is reduced thereby easing the cartridge loading process. Once the cartridges are loaded, the sliding release guide is forced to the activated state to enable the magazine assembly to be used in a firearm.

In various exemplary, non-limiting embodiments, the magazine base plate assembly of the present disclosure is directed to a firearm magazine assembly comprising a magazine body having a first upper end, a second lower end, and an internal channel extending from the first upper end to the second lower end, a spring having a first end and a second end, wherein the spring comprises a movable cartridge bed at the spring first end and a spring base at the spring second end, and a base releasably connected to the second end of the magazine body. The base comprises a base plate having an interior chamber surrounded by interior walls, wherein the interior walls comprise opposing first upper channels and opposing second lower channels and an internal sliding release guide adapted to be slidably connected to the interior chamber of the base plate in an activated or deactivated position, wherein the sliding release guide comprises a first upper end with a solid upper panel, a second lower end, opposing end walls, opposing side walls and an internal chamber, wherein the side walls comprise a saddle-back opening and parallel-spaced side openings, wherein an open channel connects the side openings to form a flexible tab for pressing inwardly into the internal chamber of the sliding guide, wherein the flexible tab comprises at least one extending tab for interacting with the opposing first upper channels of the base plate or the opposing second lower channels of the base plate.

In various exemplary, non-limiting embodiments, the present disclosure is directed to a magazine assembly comprising a magazine body having a magazine top end and a magazine bottom end and a magazine cavity extending from said magazine top end to said magazine bottom end; a base plate releasably attached or coupled to said magazine bottom end of said magazine body, wherein said base plate includes a base plate body having a base plate front wall, a base plate rear wall, and base plate opposing side walls, wherein said base plate includes a base plate passage defined by base plate opposing interior side walls, a base plate interior front wall, and a base plate interior rear wall, and wherein a base plate aperture is formed through said base plate body, from said base plate passage through said base plate front wall; a base plate insert, wherein said base plate insert includes a base plate insert front wall, a base plate insert rear wall, and base plate insert opposing side walls, wherein said base plate insert is slidably positioned within at least a portion of said base plate passage and is repeatably slidable between a retracted position and an extended position within at least a portion of said base plate passage, wherein an internal insert chamber is formed within a portion of said base plate insert, which extends from a base plate insert lower end, toward a base plate insert upper end, wherein a base plate insert aperture is formed through said base plate insert, wherein said base plate insert aperture extends from said internal insert chamber through said base plate insert front wall, and wherein in said retracted position said base plate insert aperture is aligned with at least a portion of said base plate aperture; and an insert release button, wherein said insert release button extends from an insert release button first end, along a first portion, to an extension portion and from said extension portion, along a second portion, to an insert release button second end, wherein said insert release button is positioned at least partially within said internal insert chamber such that at least a portion of said first portion is positioned through said base plate insert aperture and wherein said insert release button is repeatably slidable between an engaged position and a disengaged position, wherein if said base plate insert is in said retracted position and said insert release button is in said engaged position, at least a portion of said first portion of said insert release button extends through said base plate insert aperture and into at least a portion of said base plate aperture.

In various exemplary, non-limiting embodiments, said first portion of said insert release button is a substantially cylindrical first portion and wherein said second portion of said insert release button is a substantially cylindrical second portion.

In various exemplary, non-limiting embodiments, in said disengaged position, at least a portion of said first portion of said insert release button is withdrawn from said base plate aperture and said base plate insert is slidable toward said extended position.

In various exemplary, non-limiting embodiments, a first shoulder extends from an exterior surface of said first portion of said insert release button to an exterior surface of said extension portion and wherein a second shoulder extends from said exterior surface of said extension portion of said insert release button to an exterior surface of said second portion.

In various exemplary, non-limiting embodiments, said insert release button is biased to said engaged position.

In various exemplary, non-limiting embodiments, said insert release button is biased to said engaged position via an insert release button biasing element, wherein a first end portion of said insert release button biasing element is fitted about at least a portion of a spring catch projection formed within a portion of said internal insert chamber and a second end portion of said insert release button biasing element is fitted about at least a portion of said second portion of said insert release button.

In various exemplary, non-limiting embodiments, an inwardly extending side wall projection extends from each of said base plate opposing interior side walls, into at least a portion of said base plate passage, wherein an inwardly extending rear wall projection extends from said base plate interior rear wall, into at least a portion of said base plate passage, wherein a sidewall recess is formed in each of said opposing base plate insert side walls, wherein each sidewall recess extends from at least a portion of an insert lower end of said base plate insert, toward an insert upper end of said base plate insert, wherein a base plate insert rear wall recess is formed in said base plate insert rear wall, wherein said base plate insert rear wall recess extends from at least a portion of said insert lower end of said base plate insert, toward said insert upper end of said base plate insert, wherein each inwardly extending side wall projection is alignable within at least a portion of a respective sidewall recess, and wherein said inwardly extending rear wall projection is alignable within at least a portion of said base plate insert rear wall recess.

In various exemplary, non-limiting embodiments, interaction between each inwardly extending side wall projection and a portion of a respective sidewall recess and/or interaction between said inwardly extending rear wall projection and a portion of said base plate insert rear wall recess limits slidable movement of said base plate insert within said base plate passage of said base plate body.

In various exemplary, non-limiting embodiments, the magazine assembly also includes a magazine spring having a spring top end and a spring bottom end, wherein said magazine spring is positioned within said magazine cavity, and wherein said magazine spring contacts at least a portion of a magazine follower at said spring top end.

In various exemplary, non-limiting embodiments, a degree of tension provided by said magazine spring is reduced when said base plate insert is in said extended position.

In various exemplary, non-limiting embodiments, the present disclosure is directed to a magazine assembly comprising a base plate, wherein said base plate includes a base plate body having a base plate front wall, a base plate rear wall, and base plate opposing side walls, wherein said base plate includes a base plate passage defined by base plate opposing interior side walls, a base plate interior front wall, and a base plate interior rear wall, and wherein a base plate aperture is formed through said base plate body, from said base plate passage through said base plate front wall; a base plate insert, wherein said base plate insert includes a base plate insert front wall, a base plate insert rear wall, and base plate insert opposing side walls, wherein said base plate insert is slidably positioned within at least a portion of said base plate passage and is repeatably slidable between a retracted position and an extended position within at least a portion of said base plate passage, wherein an internal insert chamber is formed within a portion of said base plate insert, which extends from a base plate insert lower end, toward a base plate insert upper end, wherein a base plate insert aperture is formed through said base plate insert, wherein said base plate insert aperture extends from said internal insert chamber through said base plate insert front wall, and wherein in said retracted position said base plate insert aperture is aligned with at least a portion of said base plate aperture; and an insert release button, wherein said insert release button extends from an insert release button first end, along a first portion, to an extension portion and from said extension portion, along a second portion, to an insert release button second end, wherein said insert release button is positioned at least partially within said internal insert chamber such that at least a portion of said first portion is positioned through said base plate insert aperture and wherein said insert release button is repeatably slidable between an engaged position and a disengaged position, wherein if said base plate insert is in said retracted position and said insert release button is in said engaged position, at least a portion of said first portion of said insert release button extends through said base plate insert aperture and into at least a portion of said base plate aperture.

In various exemplary, non-limiting embodiments, in said disengaged position, at least a portion of said first portion of said insert release button is withdrawn from said base plate aperture and said base plate insert is slidable toward said extended position.

In various exemplary, non-limiting embodiments, a first shoulder extends from an exterior surface of said first portion of said insert release button to an exterior surface of said extension portion and wherein a second shoulder extends from said exterior surface of said extension portion of said insert release button to an exterior surface of said second portion.

In various exemplary, non-limiting embodiments, said insert release button is biased to said engaged position.

In various exemplary, non-limiting embodiments, said insert release button is biased to said engaged position via an insert release button biasing element, wherein a first end portion of said insert release button biasing element is fitted about at least a portion of a spring catch projection formed within a portion of said internal insert chamber and a second end portion of said insert release button biasing element is fitted about at least a portion of said second portion of said insert release button.

In various exemplary, non-limiting embodiments, an inwardly extending side wall projection extends from each of said base plate opposing interior side walls, into at least a portion of said base plate passage, wherein an inwardly extending rear wall projection extends from said base plate interior rear wall, into at least a portion of said base plate passage, wherein a sidewall recess is formed in each of said opposing base plate insert side walls, wherein each sidewall recess extends from at least a portion of an insert lower end of said base plate insert, toward an insert upper end of said base plate insert, wherein a base plate insert rear wall recess is formed in said base plate insert rear wall, wherein said base plate insert rear wall recess extends from at least a portion of said insert lower end of said base plate insert, toward said insert upper end of said base plate insert, wherein each inwardly extending side wall projection is alignable within at least a portion of a respective sidewall recess, and wherein said inwardly extending rear wall projection is alignable within at least a portion of said base plate insert rear wall recess.

In various exemplary, non-limiting embodiments, interaction between each inwardly extending side wall projection and a portion of a respective sidewall recess and/or interaction between said inwardly extending rear wall projection and a portion of said base plate insert rear wall recess limits slidable movement of said base plate insert within said base plate passage of said base plate body.

In various exemplary, non-limiting embodiments, the present disclosure is directed to a magazine assembly comprising a base plate, wherein said base plate includes a base plate passage defined within a portion of said base plate, and wherein a base plate aperture is formed through said base plate, from said base plate passage through a base plate front wall of said base plate; a base plate insert, wherein said base plate insert is slidably positioned within at least a portion of said base plate passage and is repeatably slidable between a retracted position and an extended position within at least a portion of said base plate passage, wherein an internal insert chamber is formed within a portion of said base plate insert, wherein a base plate insert aperture is formed through said base plate insert, wherein said base plate insert aperture extends from said internal insert chamber through a base plate insert front wall of said base plate insert, and wherein in said retracted position said base plate insert aperture is aligned with at least a portion of said base plate aperture; and an insert release button, wherein a portion of said insert release button is positioned at least partially within said internal insert chamber such that at least a portion of said insert release button is positioned through said base plate insert aperture and wherein said insert release button is repeatably slidable between an engaged position and a disengaged position, wherein if said base plate insert is in said retracted position and said insert release button is in said engaged position, at least a portion of said insert release button extends through said base plate insert aperture and into at least a portion of said base plate aperture.

In various exemplary, non-limiting embodiments, in said disengaged position, at least a portion of said first portion of said insert release button is withdrawn from said base plate aperture and said base plate insert is slidable toward said extended position.

In various exemplary, non-limiting embodiments, said insert release button is biased to said engaged position.

Accordingly, the magazine base plate assembly of the present disclosure separately and optionally provides an assembly that reduces the amount of spring bias provided by a magazine spring, to allow the magazine to be more easily loaded or reloaded.

The magazine base plate assembly of the present disclosure separately and optionally provides an assembly that is operable to quickly restore the original amount of spring bias provided by the magazine spring.

The magazine base plate assembly of the present disclosure separately and optionally provides an assembly that can be quickly and easily installed or retrofitted in place of a standard magazine base plate.

The magazine base plate assembly of the present disclosure separately and optionally provides an assembly that can be easily manipulated by a user.

The presently disclosed systems, methods, and/or apparatuses separately and optionally provide a magazine base plate assembly that can be manufactured to accommodate a variety of firearms or other applications.

The presently disclosed systems, methods, and/or apparatuses separately and optionally provide a magazine base plate assembly that can be utilized to decrease the amount of force needed to load cartridges or rounds into a firearm or other magazine.

The presently disclosed systems, methods, and/or apparatuses separately and optionally provide base plate insert that extends from the magazine body while reloading.

The presently disclosed systems, methods, and/or apparatuses separately and optionally provide a locking mechanism, i.e., locking securing tabs, to keep the base plate in place while the magazine body is in use.

These and other aspects, features, and advantages of the presently disclosed systems, methods, and/or apparatuses are described in or are apparent from the following detailed description of the exemplary, non-limiting embodiments of the presently disclosed systems, methods, and/or apparatuses and the accompanying figures. Other aspects and features of embodiments of the presently disclosed systems, methods, and/or apparatuses will become apparent to those of ordinary skill in the art upon reviewing the following description of specific, exemplary embodiments of the presently disclosed systems, methods, and/or apparatuses in concert with the figures. While features of the presently disclosed systems, methods, and/or apparatuses may be discussed relative to certain embodiments and figures, all embodiments of the presently disclosed systems, methods, and/or apparatuses can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the presently disclosed systems, methods, and/or apparatuses.

Any benefits, advantages, or solutions to problems that are described herein with regard to specific embodiments are not intended to be construed as a critical, required, or essential feature(s) or element(s) of the presently disclosed systems, methods, and/or apparatuses or the claims.

BRIEF DESCRIPTION OF THE SEVERAL VIEWS OF THE DRAWINGS

As required, detailed exemplary embodiments of the presently disclosed systems, methods, and/or apparatuses are disclosed herein; however, it is to be understood that the disclosed embodiments are merely exemplary of the presently disclosed systems, methods, and/or apparatuses that may be embodied in various and alternative forms, within the scope of the presently disclosed systems, methods, and/or apparatuses. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the presently disclosed systems, methods, and/or apparatuses.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
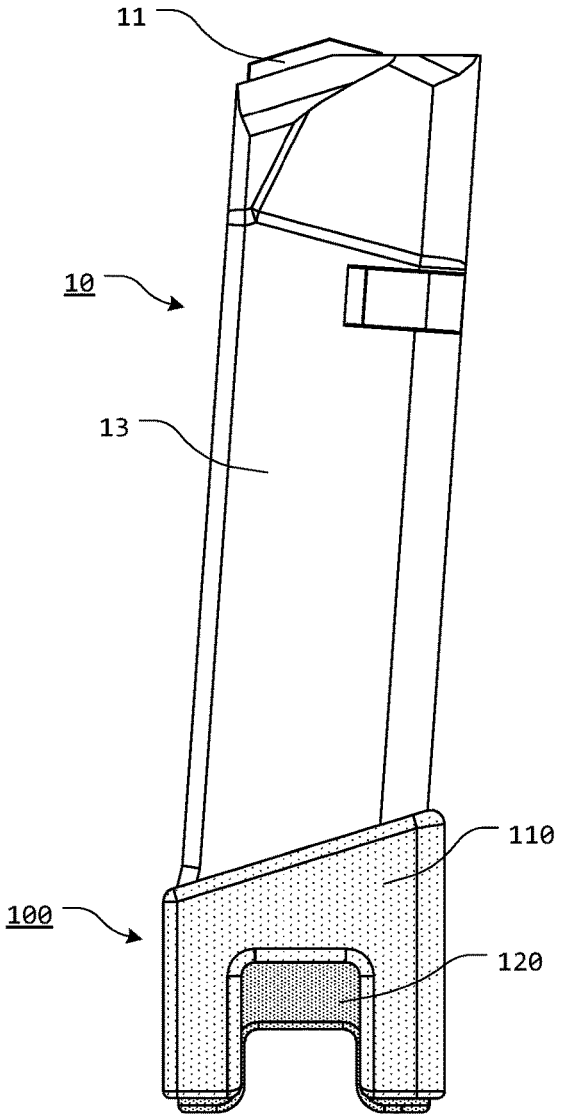
FIG. 1 illustrates a right side view of an exemplary embodiment of a magazine base plate assembly attached or coupled to a magazine body, wherein the base plate insert is in a retracted position, according to the presently disclosed systems, methods, and/or apparatuses.

For simplicity and clarification, the design factors and operating principles of the magazine base plate assembly according to the presently disclosed systems, methods, and/or apparatuses are explained with reference to various exemplary embodiments of a magazine base plate assembly according to the presently disclosed systems, methods, and/or apparatuses. The basic explanation of the design factors and operating principles of the magazine base plate assembly is applicable for the understanding, design, and operation of the magazine base plate assembly of the presently disclosed systems, methods, and/or apparatuses. It should be appreciated that the magazine base plate assembly can be adapted to many applications where a magazine can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "magazine", "magazine body", "base plate", "base plate insert", and "magazine assembly" are used for a basic explanation and understanding of the operation of the systems, methods, and apparatuses of the present disclosure. Therefore, the terms "magazine", "magazine body", "base plate", "base plate insert", and "magazine assembly" are not to be construed as limiting the systems, methods, and apparatuses of the present disclosure.

Furthermore, it should be appreciated that, for simplicity and clarification, the embodiments of the present disclosure will be described with reference to a magazine base plate assembly pistol-type magazine. However, it should be appreciated that the operating principles of the disclosed magazine base plate assembly may also be employed to construct magazine base plate assembly rifle magazines, shotgun magazines, or other magazines for any real, replica, training, or toy semiautomatic-type handgun, rifle, shotgun, and/or less than lethal product.

Figure 30:
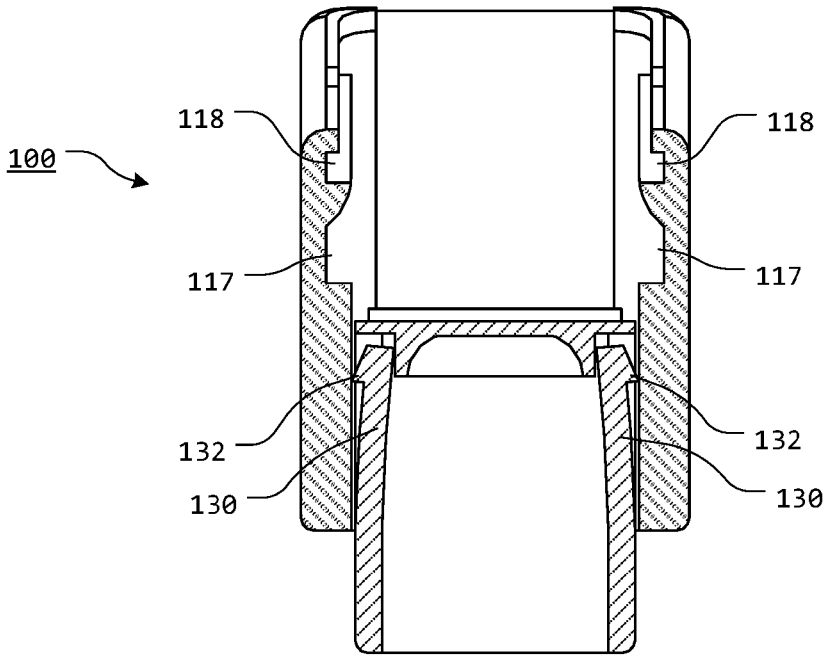
FIG. 30 illustrates a rear, cross-sectional view of an exemplary embodiment of a base plate inserted within an exemplary embodiment of a base plate insert, wherein the base plate insert is urged toward an extended position according to the presently disclosed systems, methods, and/or apparatuses.
Figure 31:
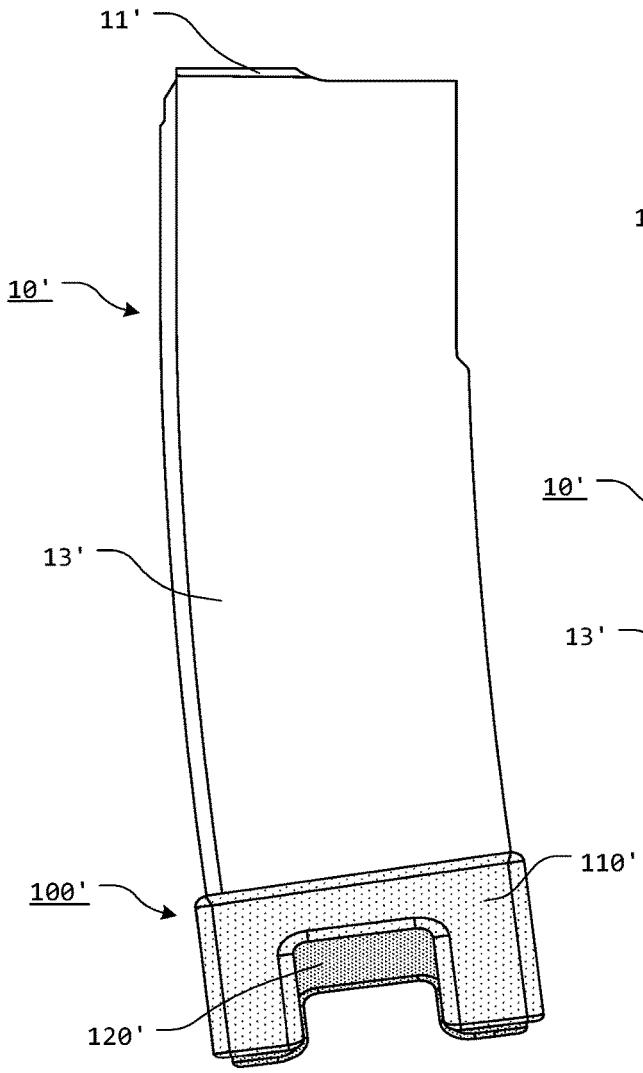
FIG. 31 illustrates a right side view of an exemplary embodiment of a magazine base plate assembly attached or coupled to a magazine body, wherein the base plate insert is in a retracted position, according to the presently disclosed systems, methods, and/or apparatuses.
Figure 32:
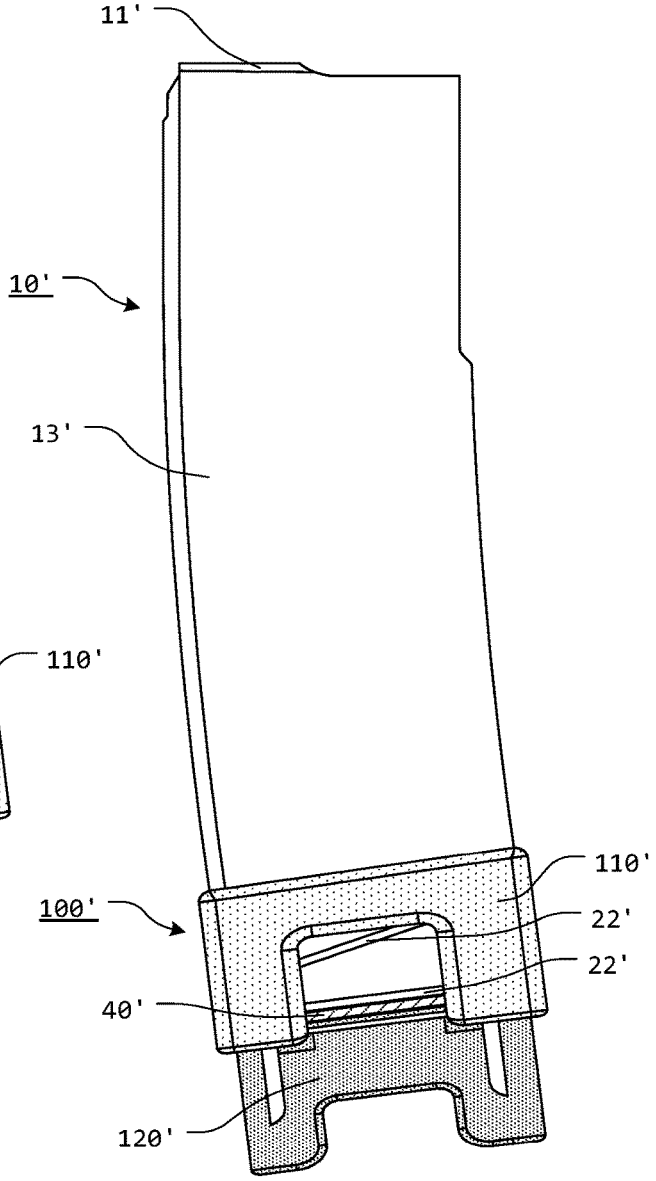
FIG. 32 illustrates a right side view of an exemplary embodiment of a magazine base plate assembly attached or coupled to a magazine body, wherein the base plate insert is in an extended position, according to the presently disclosed systems, methods, and/or apparatuses.
Figure 33:
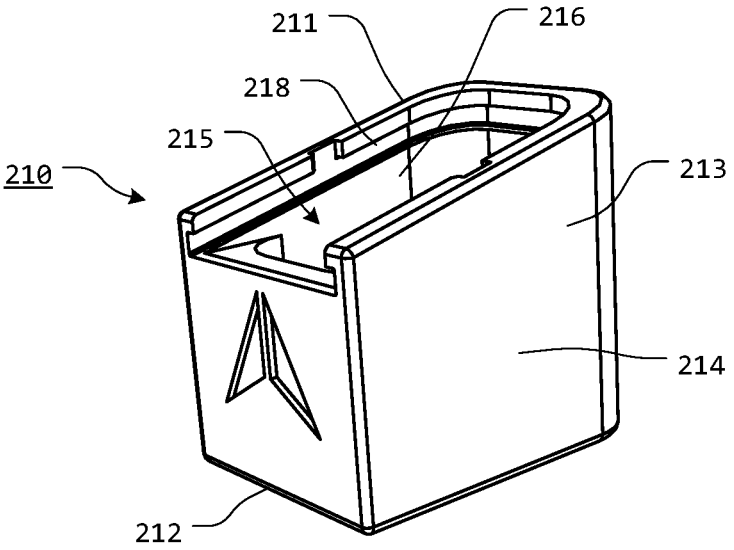
FIG. 33 illustrates an upper, rear, perspective view of an exemplary embodiment of a base plate, according to the presently disclosed systems, methods, and/or apparatuses.
Figure 34:
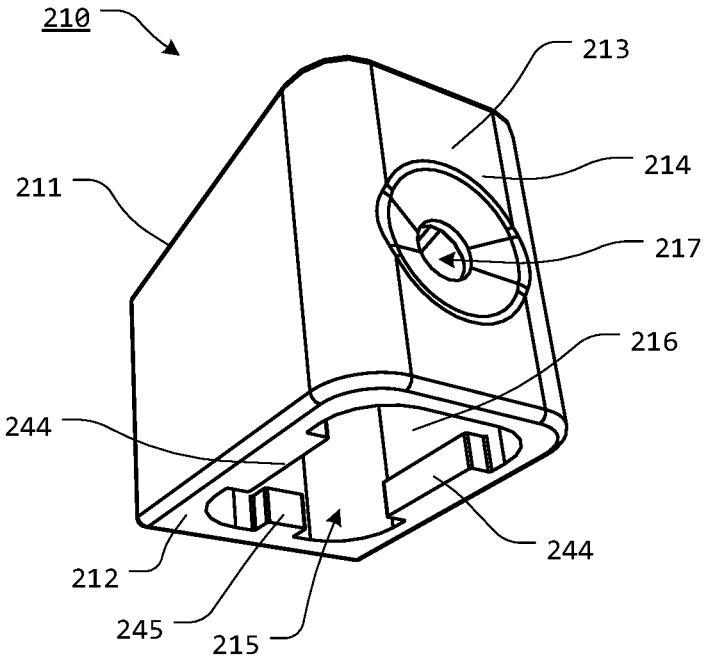
FIG. 34 illustrates a lower, front, perspective view of an exemplary embodiment of a base plate, according to the presently disclosed systems, methods, and/or apparatuses.
Figure 35:
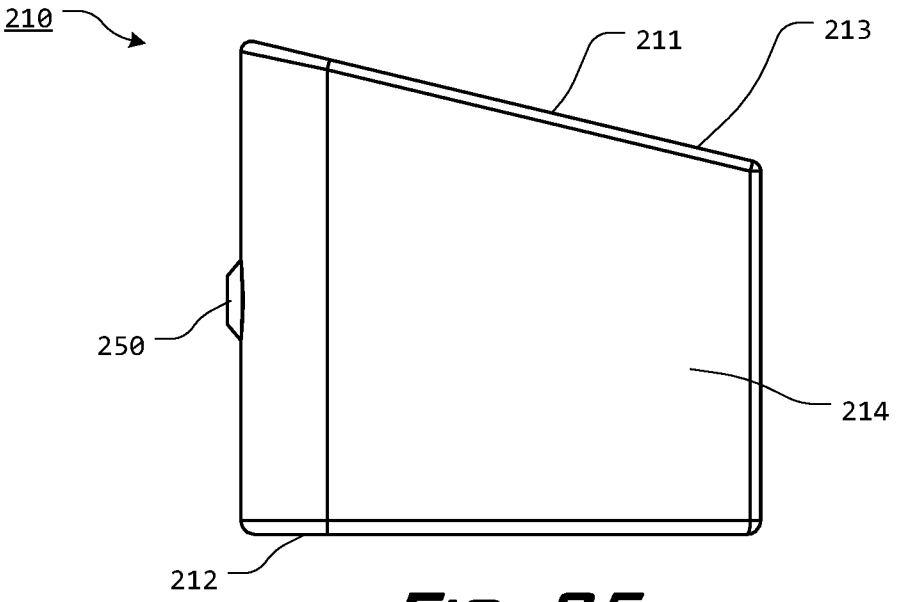
FIG. 35 illustrates a right side view of an exemplary embodiment of a base plate, according to the presently disclosed systems, methods, and/or apparatuses.
Figure 36:
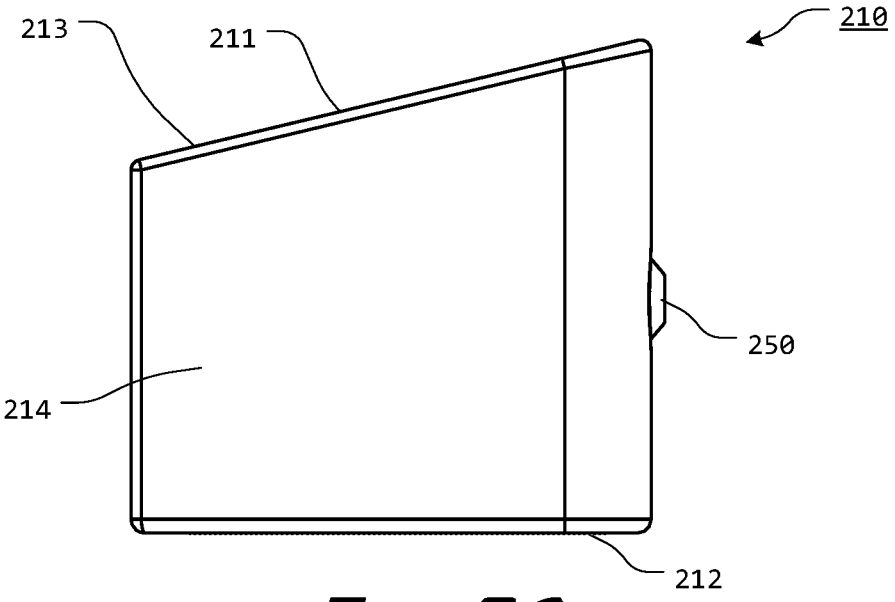
FIG. 36 illustrates a left side view of an exemplary embodiment of a base plate, according to the presently disclosed systems, methods, and/or apparatuses.
Figure 37:
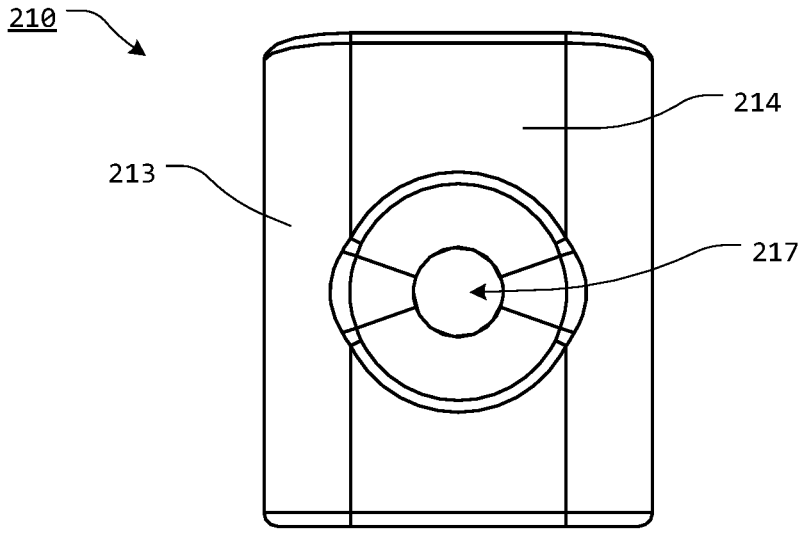
FIG. 37 illustrates a front view of an exemplary embodiment of a base plate, according to the presently disclosed systems, methods, and/or apparatuses.
Figure 38:
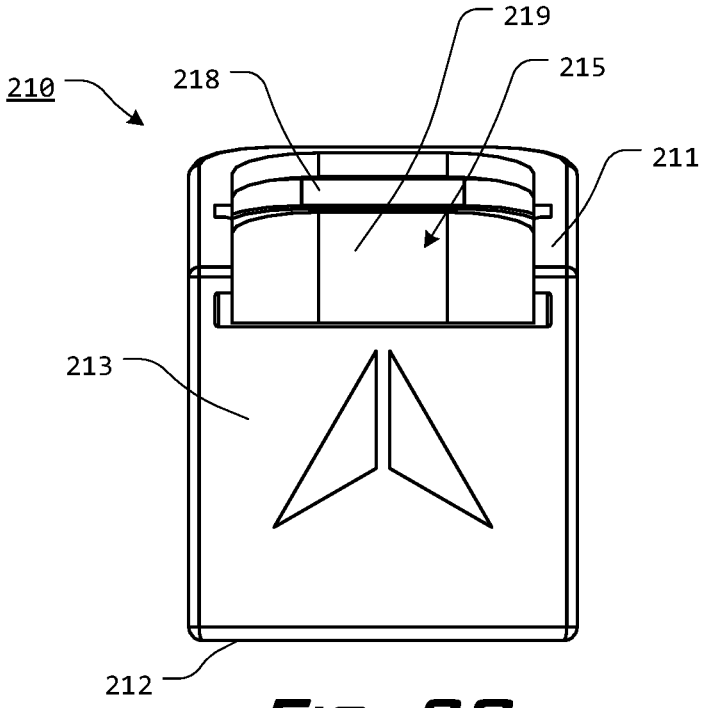
FIG. 38 illustrates a rear view of an exemplary embodiment of a base plate, according to the presently disclosed systems, methods, and/or apparatuses.
Figure 39:
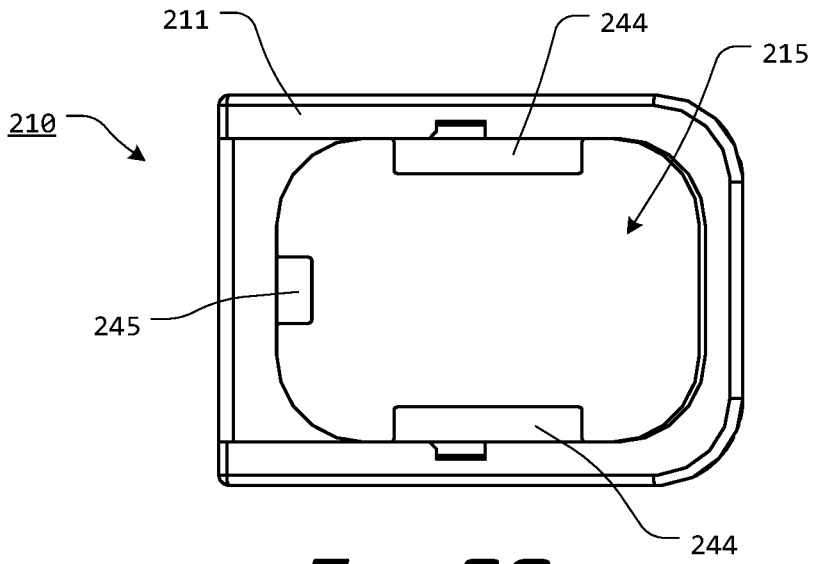
FIG. 39 illustrates a top view of an exemplary embodiment of a base plate, according to the presently disclosed systems, methods, and/or apparatuses.
Figure 40:
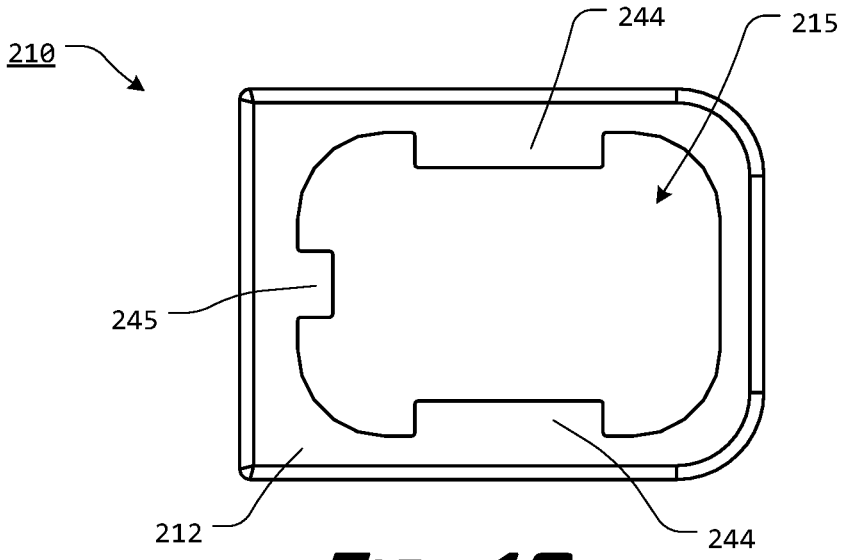
FIG. 40 illustrates a bottom view of an exemplary embodiment of a base plate, according to the presently disclosed systems, methods, and/or apparatuses.
Figure 41:
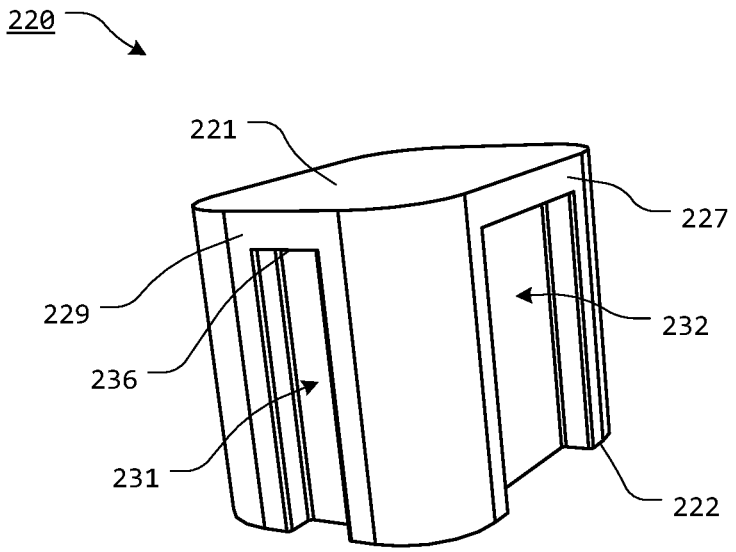
FIG. 41 illustrates an upper, front, perspective view of an exemplary embodiment of a base plate insert, according to the presently disclosed systems, methods, and/or apparatuses.
Figure 42:
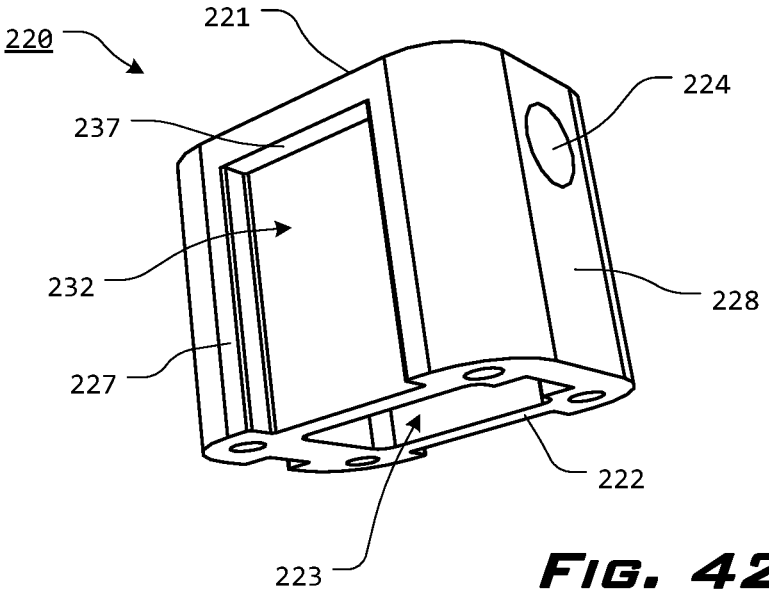
FIG. 42 illustrates a lower, front, perspective view of an exemplary embodiment of a base plate insert, according to the presently disclosed systems, methods, and/or apparatuses.
Figure 43:
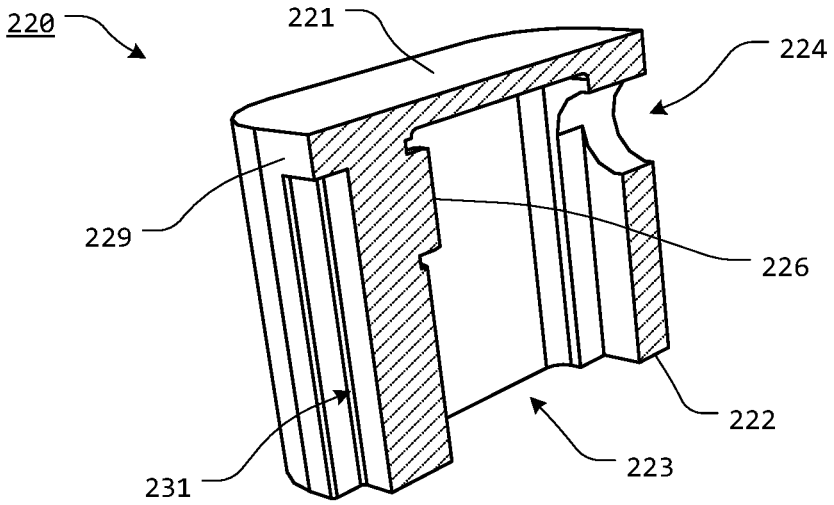
FIG. 43 illustrates an upper, rear, cross-sectional, perspective view of an exemplary embodiment of a base plate insert, according to the presently disclosed systems, methods, and/or apparatuses.
Figure 44:
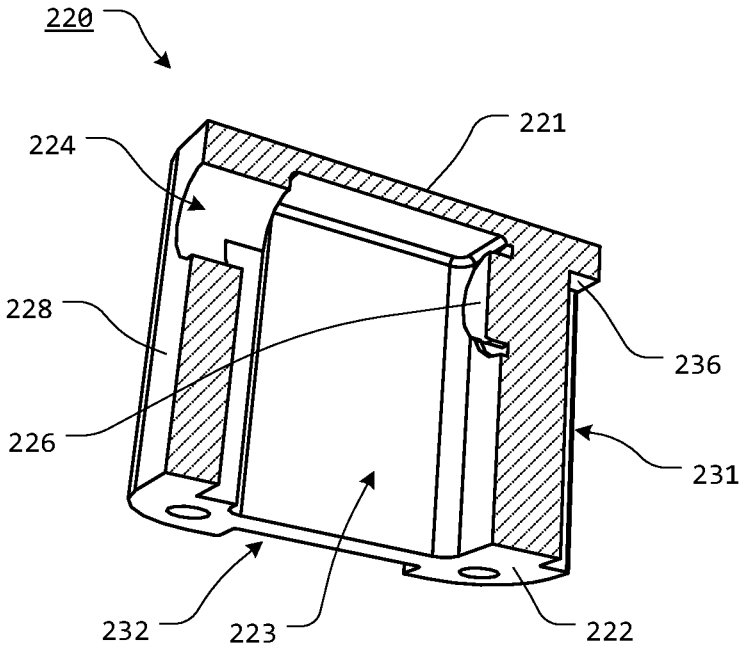
FIG. 44 illustrates a lower, front, cross-sectional, perspective view of an exemplary embodiment of a base plate insert, according to the presently disclosed systems, methods, and/or apparatuses.
Figure 45:
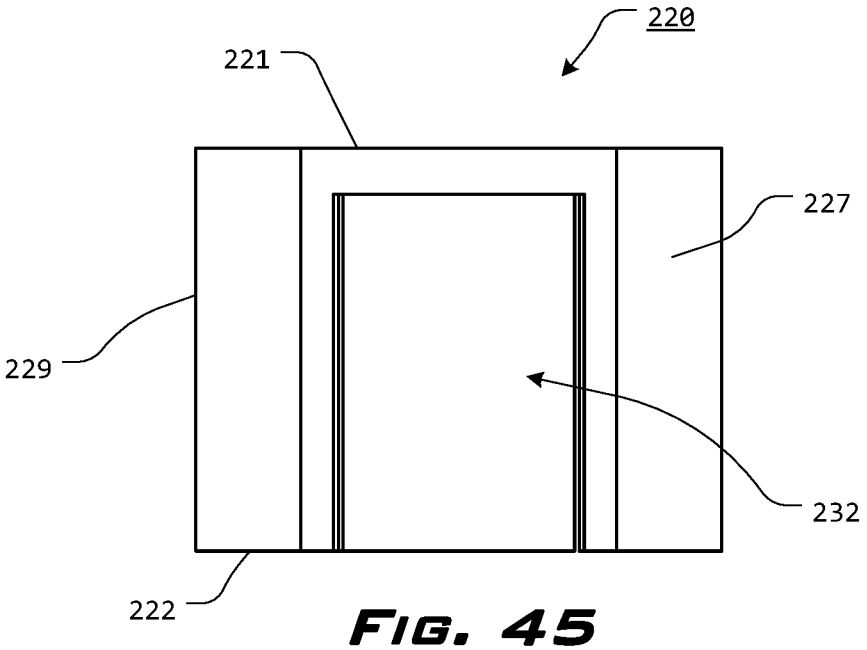
FIG. 45 illustrates a right side view of an exemplary embodiment of a base plate insert, according to the presently disclosed systems, methods, and/or apparatuses.
Figure 46:
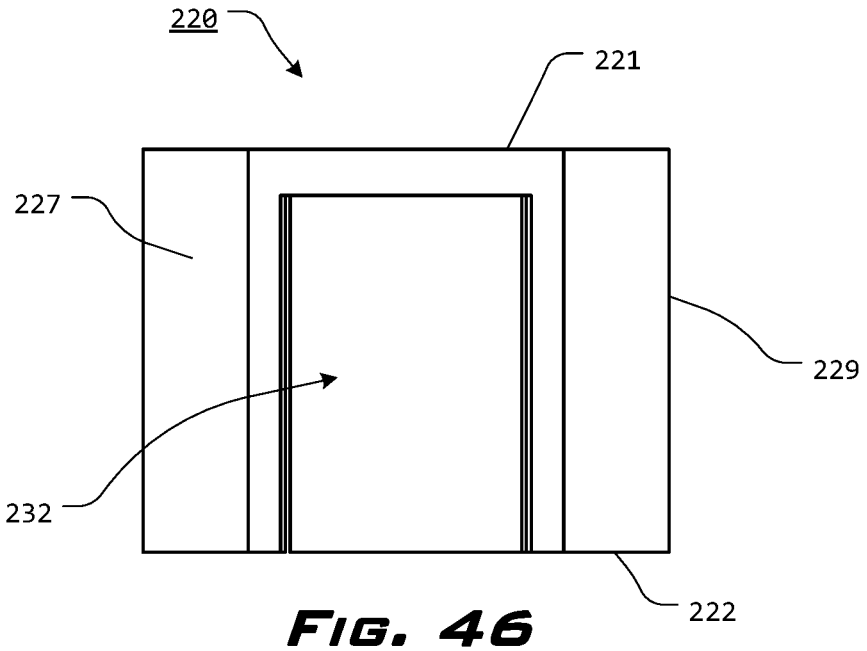
FIG. 46 illustrates a left side view of an exemplary embodiment of a base plate insert, according to the presently disclosed systems, methods, and/or apparatuses.
Figure 47:
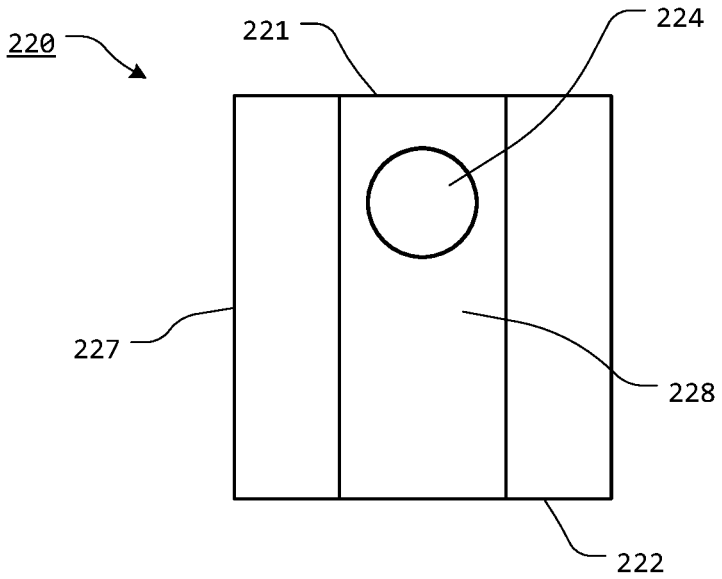
FIG. 47 illustrates a front view of an exemplary embodiment of a base plate insert, according to the presently disclosed systems, methods, and/or apparatuses.
Figure 48:
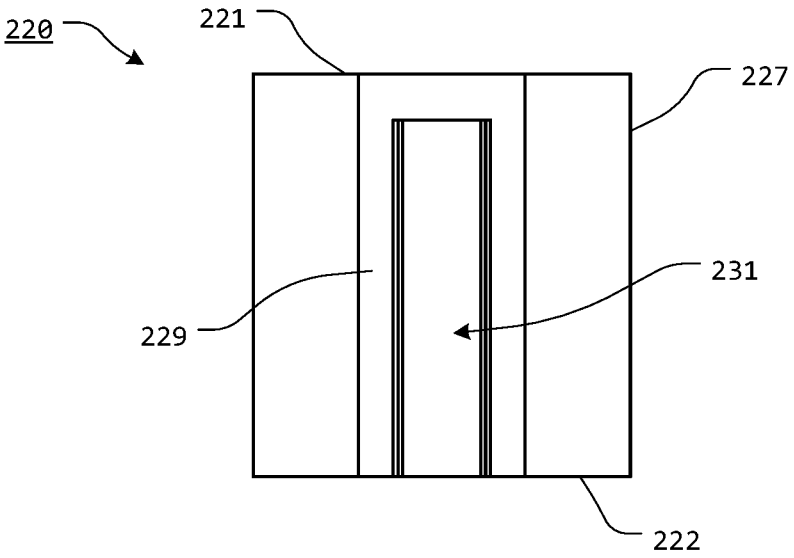
FIG. 48 illustrates a rear view of an exemplary embodiment of a base plate insert, according to the presently disclosed systems, methods, and/or apparatuses.
Figure 49:
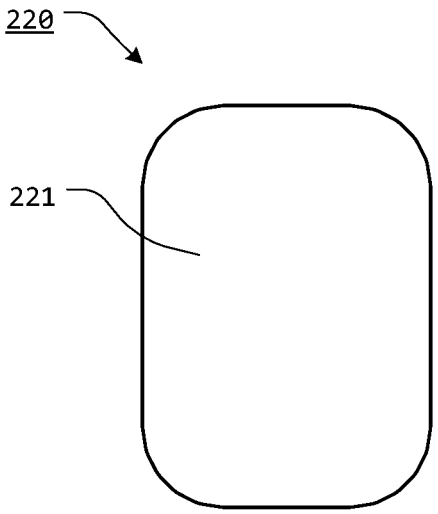
FIG. 49 illustrates a top view of an exemplary embodiment of a base plate insert, according to the presently disclosed systems, methods, and/or apparatuses.
Figure 50:
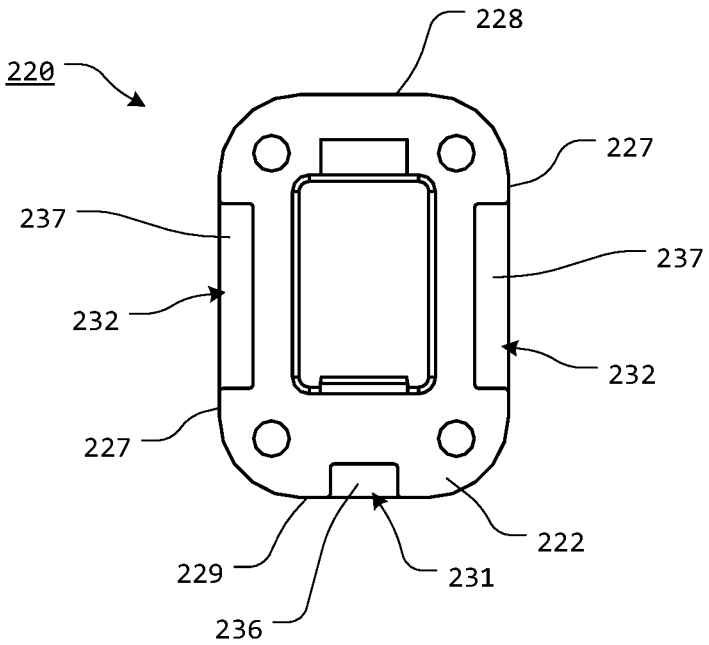
FIG. 50 illustrates a bottom view of an exemplary embodiment of a base plate insert, according to the presently disclosed systems, methods, and/or apparatuses.

Turning now to the appended drawing figures, FIGS. 1-30 illustrate certain elements, components, and/or aspects of a magazine base plate assembly 100, while FIGS. 31-32 illustrate certain elements, components, and/or aspects of a magazine base plate assembly 100', according to the present disclosure. FIGS. 33-59 illustrate an additional exemplary embodiment of a magazine base plate assembly 200. It should be appreciated that, by way of illustration and not limitation, the magazine base plate assembly 100 and the magazine base plate assembly 200 are illustrated as being adapted to be utilized in conjunction with a semiautomatic-type handgun magazine, while the magazine base plate assembly 100' is illustrated as being adapted to be utilized in conjunction with an AR-15 or M-4-type magazine. However, the magazine base plate assembly 100, the magazine base plate assembly 200, and the magazine base plate assembly 100' of the present disclosure are not so limited.

In illustrative, non-limiting embodiment(s) of the presently disclosed systems, methods, and/or apparatuses, as illustrated in FIGS. 1-30, the illustrated, exemplary magazine base plate assembly 100 includes at least some of a base plate 110 and a base plate insert 120. FIGS. 1-4, illustrate different views of a cartridge or round magazine assembly 10. As illustrated, the magazine assembly 10 is intended for a pistol, such as a semi-automatic type pistol. However, the magazine assembly 10 can be modified and adapted for use with any magazine-loading firearm, including pistols, rifles, shotguns, or other magazines for any real, replica, training, or toy semiautomatic-type handgun, rifle, shotgun, and/or less than lethal product.

The magazine assembly 10 includes a magazine body 13 having a magazine top end 11 and a magazine bottom end 12. The magazine body 13 has a magazine cavity 15 formed therein, extending from the magazine top end 11 to the magazine bottom end 12 for receiving a magazine spring 20. A magazine follower 30 is positioned within the magazine cavity 15, so as to be slidable within the magazine cavity 15. A spring top end 21 of the magazine spring 20 contacts and urges the magazine follower 30 toward the magazine top end 11 of the magazine body 13. The magazine follower 30 is spring biased toward the magazine top end 11, so as to contact and urge at least one cartridge (not shown), placed within the magazine cavity 15, toward the magazine feed lips proximate the magazine top end 11 of the magazine body 13. The spring bottom end 22 of the magazine spring 20 is urged against a magazine insert or magazine lock plate 40, which is positioned within the magazine cavity 15, proximate the magazine bottom end 12.

The magazine body 13 also includes a protruding edge 14 extending around at least a portion of the magazine bottom end 12. The protruding edge 14 is utilized to allow a magazine base plate to be attached or coupled to the magazine bottom end 12.

It should also be appreciated that a more detailed explanation of the specific components of the magazine assembly 10, instructions regarding how to install the magazine follower 30, magazine spring 20, and magazine lock plate 40 within the magazine cavity 15, methods for using the magazine assembly 10, once assembled, and certain other items and/or techniques necessary for the implementation and/or operation of the various exemplary embodiments of the present disclosure are not provided herein because such background information will be known to one of ordinary skill in the art. Therefore, it is believed that the level of description provided herein is sufficient to enable one of ordinary skill in the art to understand and practice the systems, methods, and apparatuses of the presentation, as described.

As illustrated, the base plate 110 is removably attached or coupled to the magazine bottom end 12, via interaction between the protruding edge 14 of the magazine body 13 and the magazine attachment channels 118 formed within each of the opposing interior side walls 116 of the base plate 110. The base plate body 113 of the base plate 110 is preferably designed to slidably engage the magazine body 13 at the magazine bottom end 12 by engaging the protruding edge 14 of the magazine body 13 with the magazine attachment channels 118 positioned on the opposing interior side walls 116 at the base plate upper end 111 of the base plate body 113. In this manner, the base plate 110 is attached or coupled to the magazine bottom end 12 in a manner similar to the attachment of a standard base plate to the magazine bottom end 12.

As illustrated in greater detail in FIGS. 5-30, the base plate 110 comprises at least some of a base plate body 113 extending from a base plate upper end 111 to a base plate lower end 112 and having an exterior wall 114. The base plate body 113 further includes opposing interior side walls 116 at least partially defining a base plate passage 115. The base plate passage 115 extends through the base plate 110 from the base plate upper end 111 through the base plate lower end 112. Inwardly extending projections 144 extend, proximate the base plate lower end 112, into at least a portion of the base plate passage 115. Similarly, an inwardly extending projection 145 extends, proximate the base plate lower end 112, into at least a portion of the base plate passage 115.

As discussed above, magazine attachment channels 118 are formed within at least a portion of each of the opposing interior side walls 116. The magazine attachment channels 118 are formed so as to slidably interact with the protruding edge 14 of the magazine body 13 to attach or couple the base plate 110 to the magazine body 13. In certain exemplary, nonlimiting embodiments, securing tabs 119 and/or securing recesses are formed so as to interact with at least a portion of the protruding edge 14 to further secure the base plate 110 to the magazine body 13. In these and similar exemplary embodiments, the base plate 110 can be removed from the magazine body 13 by pressing the securing tabs 119 in an outward direction, and slidably removing the base plate 110 from the magazine body 13.

At least one pair of opposing channels 117 are formed within at least a portion of the opposing interior side walls 116. In various exemplary embodiments, the opposing channels 117 are formed as an elongate channel formed along a portion of each opposing interior side wall 116. In various exemplary embodiments, a surface closest to the base plate lower end 112, which extends from the opposing interior side wall 116 to form the opposing channel 117, is formed so as to have a planar surface that is substantially perpendicular (or substantially 90°) relative to a planar surface forming the opposing interior side wall 116. It should be appreciated that in certain exemplary embodiments, at least one additional pair of opposing channels (not illustrated) are also formed within at least a portion of the opposing interior side walls 116.

The base plate insert 120 extends from an insert upper end 121 to an insert lower end 122 and includes opposing side walls 127 and opposing end walls 129. A recess in the insert upper end 121 forms a lock plate recess 125. The lock plate recess 125 is formed so as to interact with at least a portion of the magazine lock plate 40 to maintain the magazine lock plate 40 in a desired position relative to the magazine spring 20 and the magazine cavity 15 when the base plate 110 is attached or coupled to the magazine body 13. In various exemplary embodiments, and apertures formed through a portion of the lock plate recess 125, which corresponds to a protrusion that extends from the magazine lock plate 40. Interaction between the aperture and the protrusion, if included, further secure the magazine lock plate 40 within the lock plate recess 125.

An outwardly extending projection 146 is formed so as to extend from at least a portion of the insert upper end 121, away from the adjacent opposing end wall 129. Similarly, an outwardly extending projection 147 is formed so as to extend from at least a portion of the insert upper end 121, away from the adjacent opposing end wall 129.

An internal insert chamber 123 is formed within the base plate insert 120 and extends from the insert lower end 122, toward the insert upper end 121. In various exemplary embodiments, one or more support walls 124 extend from a top wall of the internal insert chamber 123, toward the insert lower end 122. The support walls 124 may optionally be downwardly mounted from the insert upper end 121 of the base plate insert 120 into the internal insert chamber 123 to create a block for the flexible tabs 130, thereby preventing the flexible tabs 130 from extending too far into the internal insert chamber 123 and possibly breaking from the opposing side walls 127.

While the opposing end walls 129 are generally solid, i.e., having no indentation or perforations, the opposing side walls 127 include a saddleback recess 135 and spaced apart side openings 138 and 139, which extend through the opposing side walls 127. An open channel 137 connects the spaced side openings 138 and 139 on each discrete opposing side wall 127. A flexible tab 130 is defined between the spaced side openings 138 and 139 and the open channel 137. Each flexible tab 130 can be pressed or urged inwardly, such that at least a portion of each extending tab 132 can extend into at least a portion of the internal insert chamber 123 of the base plate insert 120. When each flexible tab 130 is released, the natural bias of each flexible tab 130 urges each flexible tab 130 to return to its original position.

In various exemplary embodiments, each flexible tab 130 includes a ramp portion that extends outward from the flexible tab 130 to a shoulder. The shoulder then returns to the surface of the flexible tab 130. In various exemplary embodiments, the shoulder includes a planar surface that extends approximately 90° relative to a planar surface formed by the flexible tab 130.

At least one and optionally two extending tabs 132 (as shown) extend from an area proximate the upper portion 131 of each flexible tab 130. The extending tabs 132 are designed to interact with both sets of opposing channels 117 on the opposing interior side wall 116 of the base plate body 113.

The base plate insert 120 is formed so as to be slidably positionable within at least a portion of the base plate passage 115 of the base plate body 113.

During installation of the base plate insert 120 into the base plate 110, the base plate insert 120 is initially aligned with the base plate passage 115 and inserted, from the base plate upper end 111, into the base plate passage 115. As the base plate insert 120 is urged further within the base plate passage 115, the extending tabs 132 slide within the base plate passage 115 until the extending tabs 132 reach the opposing channels 117. When the extending tabs 132 reach the opposing channels 117, the extending tabs 132 extend a sufficient distance within the opposing channels 117 to keep the base plate insert 120 from being further inserted into the base plate passage 115, toward the base plate lower end 112.

During assembly of the components of the magazine assembly 10, the magazine follower 30 is positioned within the magazine cavity 15. Then, the magazine spring 20 is slidably placed into the magazine cavity 15 of the magazine body 13 by sliding the spring top end 21 of the magazine spring 20 with the magazine follower 30 into the magazine bottom end 12 of the magazine body 13 until the magazine follower 30 is adjacent with the magazine top and 11 of the magazine body 13.

The magazine lock plate 40 is then positioned adjacent the spring bottom and 22 and the magazine lock plate 40 is seated within at least a portion of the lock plate recess 125 of the base plate insert 120.

Once the base plate insert 120 is appropriately positioned within the base plate 110, the magazine base plate assembly 100 the base plate 110 is slidably mounted on the magazine body 13 by contacting the magazine attachment channels 118 of the base plate body 113 with the protruding edges 14 of the magazine body 13 and securing the base to the magazine body 13.

Thus, the magazine spring 20 is tension mounted within the magazine body 13, thereby exerting spring biasing tension to the magazine follower 30 and the magazine lock plate 40. With the extending tabs 132 within the opposing channels 117, the magazine base plate assembly 100 is in the retracted position. In the retracted position, as illustrated in FIGS. 1, 3, 24, 27, and 29, the extending tabs 132 interact with the opposing channels 117 of the base plate body 113.

To move the magazine base plate assembly 100 from the retracted position to the extent position, the flexible tabs 130 are urged inward, such that the extending tabs 132 are withdrawn from the opposing channels 117. As illustrated in FIG. 30, the base plate insert 120 is able to move, within the base plate passage 115, toward the extended position.

Figure 2:
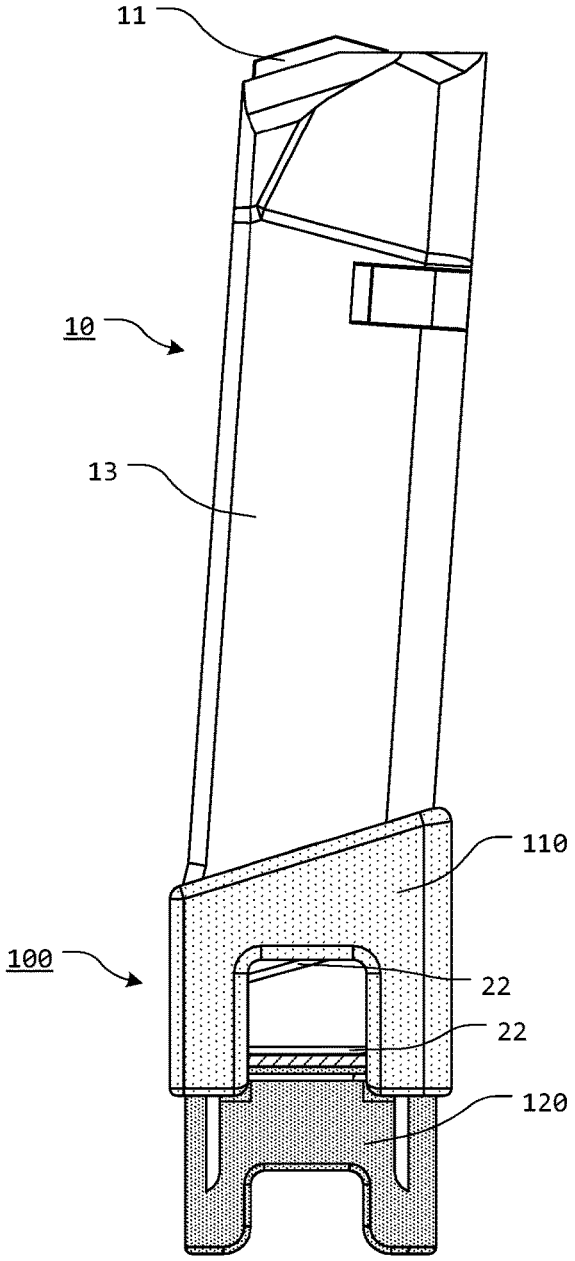
FIG. 2 illustrates a right side view of an exemplary embodiment of a magazine base plate assembly attached or coupled to a magazine body, wherein the base plate insert is in an extended position, according to the presently disclosed systems, methods, and/or apparatuses.
Figure 3:
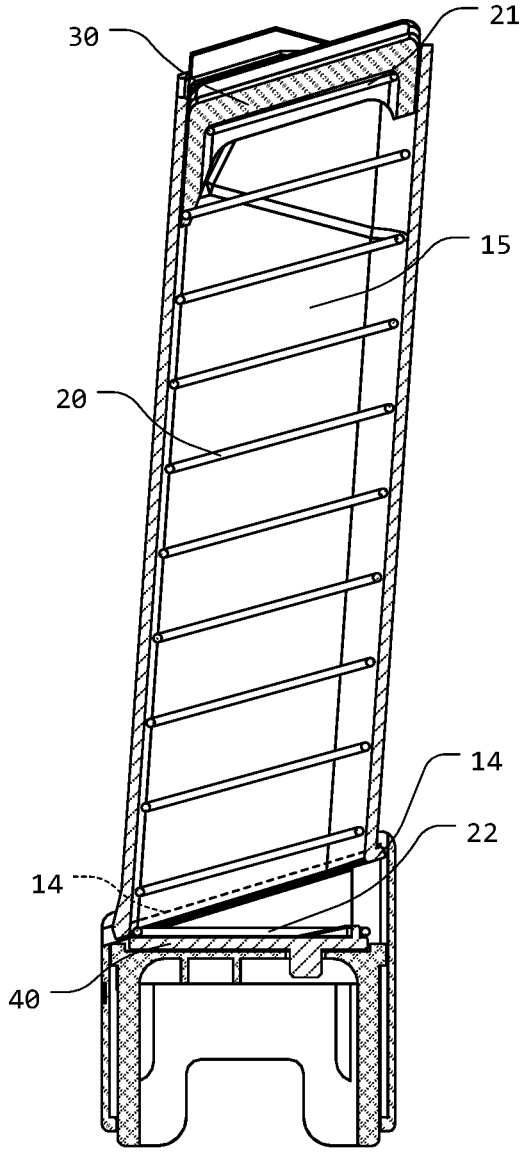
FIG. 3 illustrates a right side, cross-sectional view of an exemplary embodiment of a magazine base plate assembly attached or coupled to a magazine body, wherein the base plate insert is in a retracted position, according to the presently disclosed systems, methods, and/or apparatuses.
Figure 4:
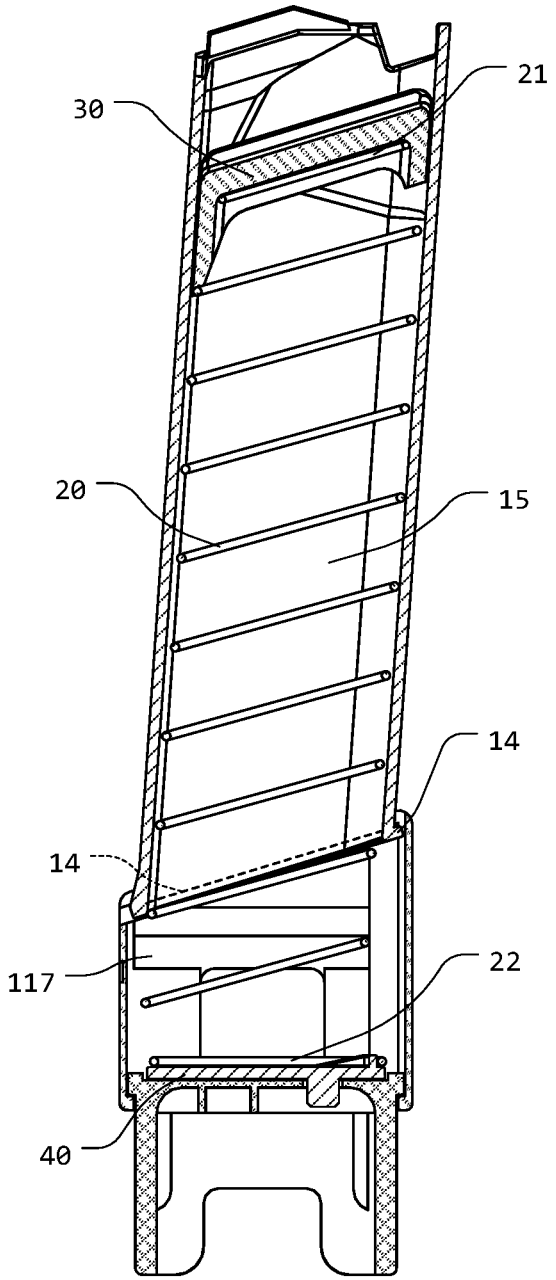
FIG. 4 illustrates a right side, cross-sectional view of an exemplary embodiment of a magazine base plate assembly attached or coupled to a magazine body, wherein the base plate insert is in an extended position, according to the presently disclosed systems, methods, and/or apparatuses.
Figure 5:
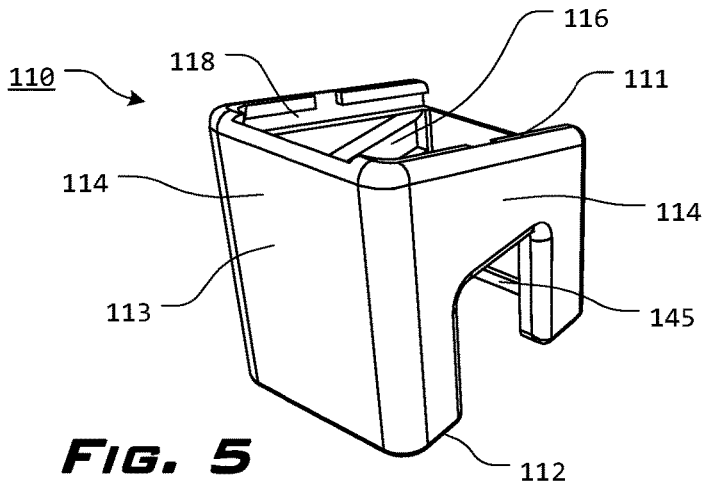
FIG. 5 illustrates an upper, front, perspective view of an exemplary embodiment of a base plate, according to the presently disclosed systems, methods, and/or apparatuses.
Figure 6:
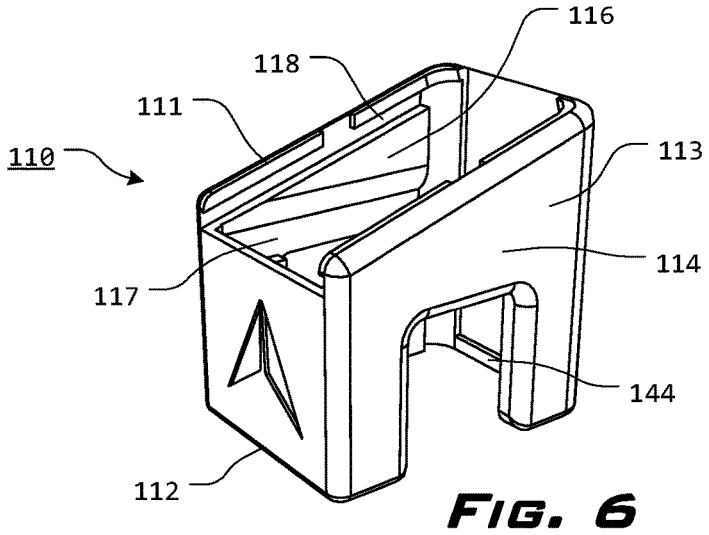
FIG. 6 illustrates an upper, rear, perspective view of an exemplary embodiment of a base plate, according to the presently disclosed systems, methods, and/or apparatuses.
Figure 7:
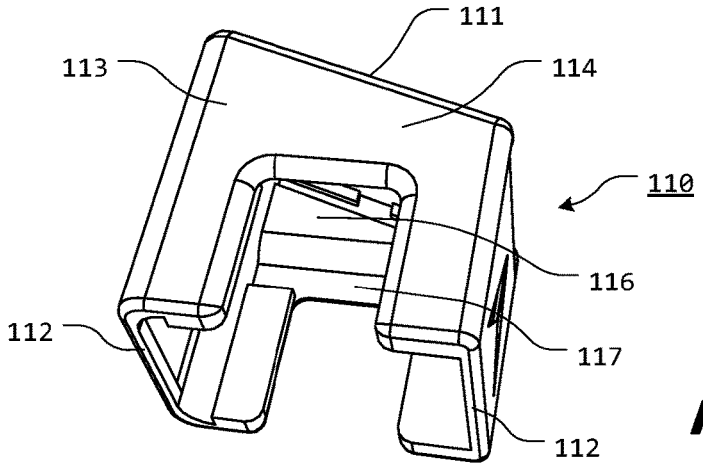
FIG. 7 illustrates a lower, side, perspective view of an exemplary embodiment of a base plate, according to the presently disclosed systems, methods, and/or apparatuses.
Figure 8:
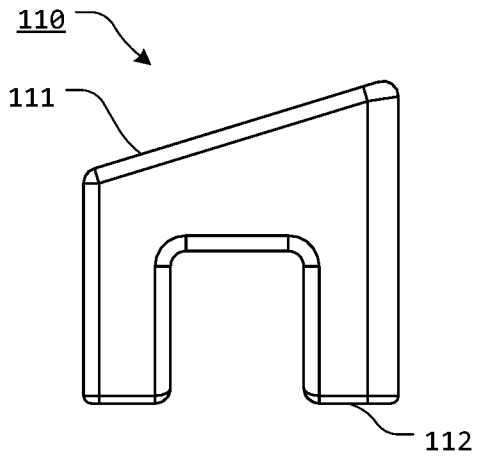
FIG. 8 illustrates a left side view of an exemplary embodiment of a base plate, according to the presently disclosed systems, methods, and/or apparatuses.
Figure 9:
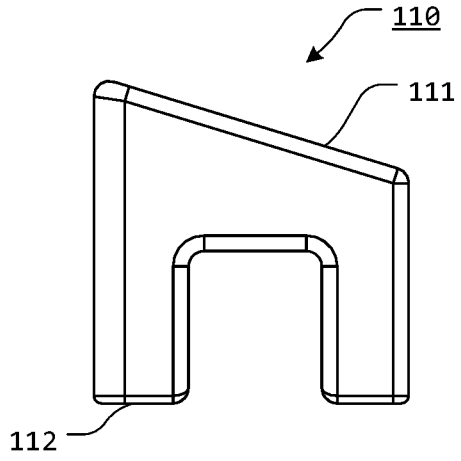
FIG. 9 illustrates a right side view of an exemplary embodiment of a base plate, according to the presently disclosed systems, methods, and/or apparatuses.
Figure 10:
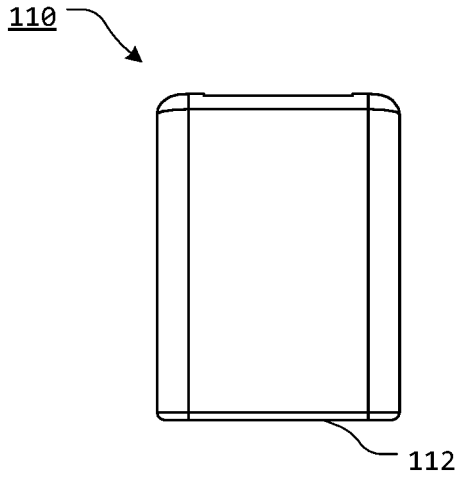
FIG. 10 illustrates a front view of an exemplary embodiment of a base plate, according to the presently disclosed systems, methods, and/or apparatuses.
Figure 11:
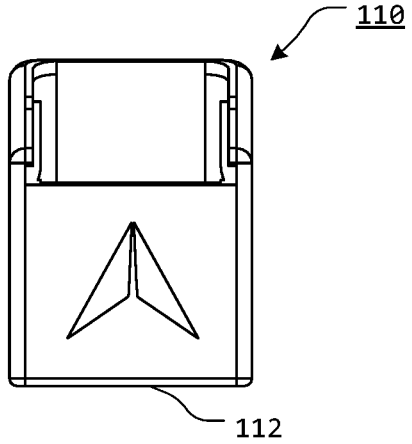
FIG. 11 illustrates a rear view of an exemplary embodiment of a base plate, according to the presently disclosed systems, methods, and/or apparatuses.
Figure 12:
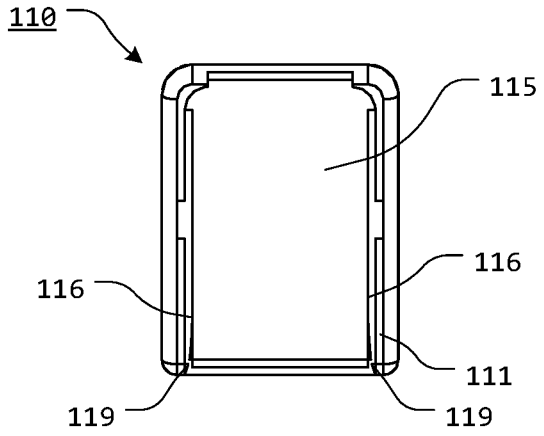
FIG. 12 illustrates a top view of an exemplary embodiment of a base plate, according to the presently disclosed systems, methods, and/or apparatuses.
Figure 13:
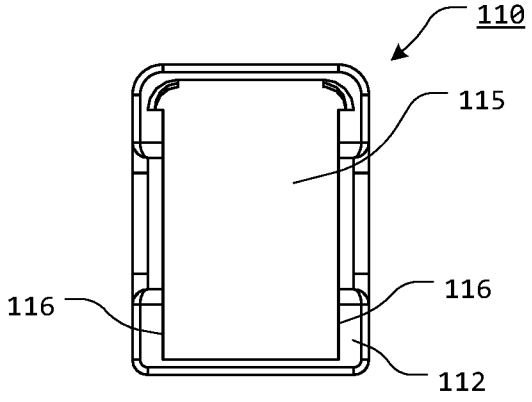
FIG. 13 illustrates a bottom view of an exemplary embodiment of a base plate, according to the presently disclosed systems, methods, and/or apparatuses.
Figure 14:
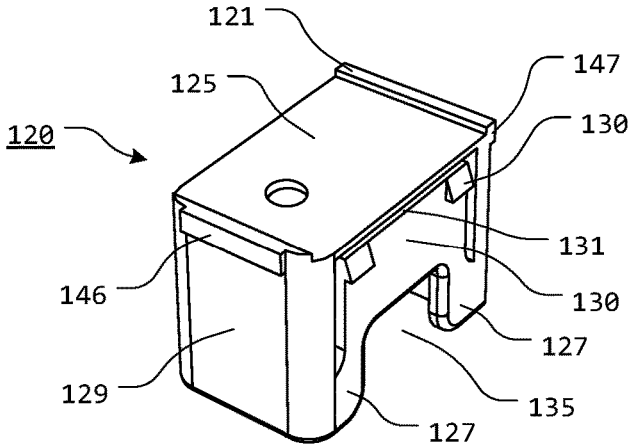
FIG. 14 illustrates an upper, front, perspective view of an exemplary embodiment of a base plate insert, according to the presently disclosed systems, methods, and/or apparatuses.
Figure 15:
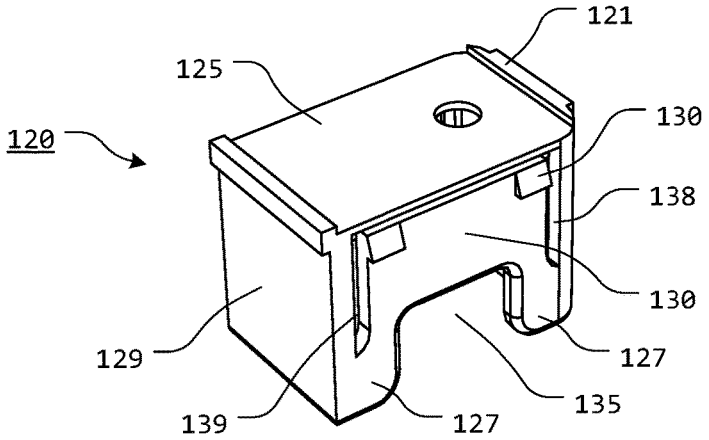
FIG. 15 illustrates an upper, side, perspective view of an exemplary embodiment of a base plate insert, according to the presently disclosed systems, methods, and/or apparatuses.
Figure 16:
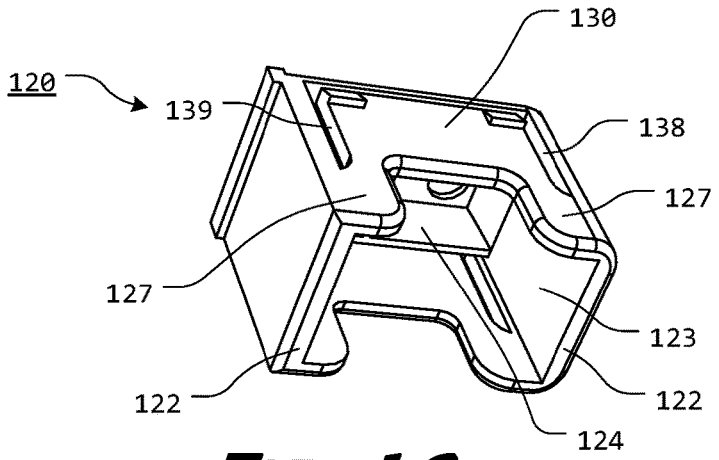
FIG. 16 illustrates a lower, side, perspective view of an exemplary embodiment of a base plate insert, according to the presently disclosed systems, methods, and/or apparatuses.
Figure 17:
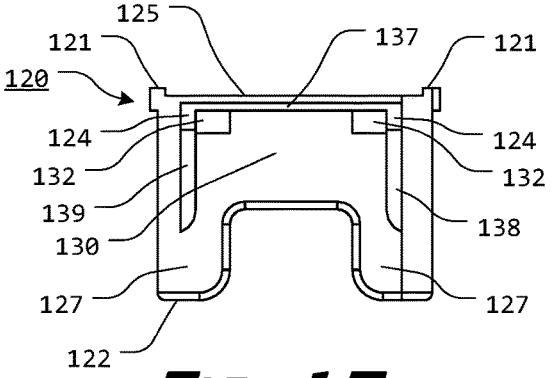
FIG. 17 illustrates a left side view of an exemplary embodiment of a base plate insert, according to the presently disclosed systems, methods, and/or apparatuses.
Figure 18:
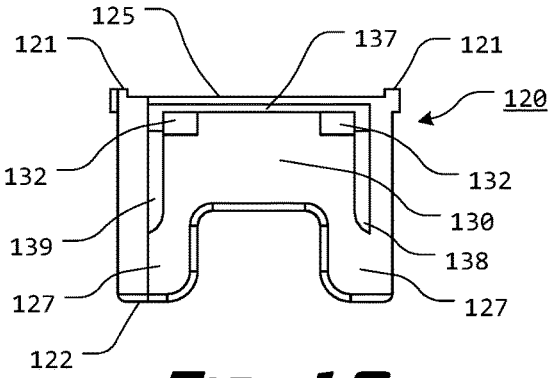
FIG. 18 illustrates a right side view of an exemplary embodiment of a base plate insert, according to the presently disclosed systems, methods, and/or apparatuses.
Figure 19:
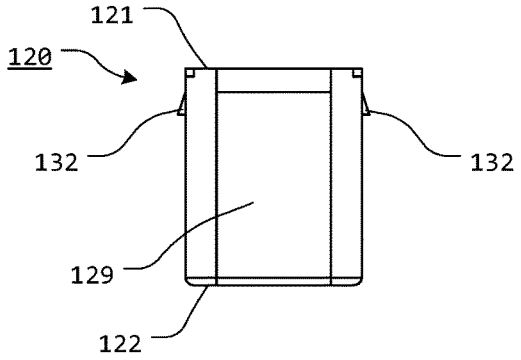
FIG. 19 illustrates a front view of an exemplary embodiment of a base plate insert, according to the presently disclosed systems, methods, and/or apparatuses.
Figure 20:
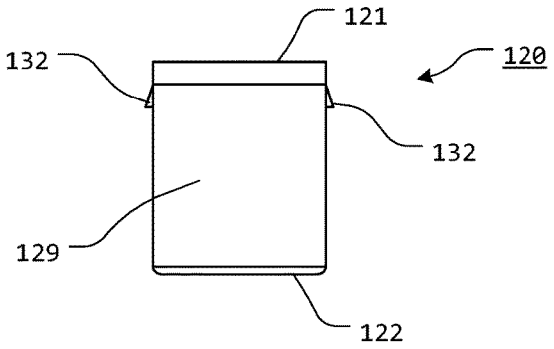
FIG. 20 illustrates a rear view of an exemplary embodiment of a base plate insert, according to the presently disclosed systems, methods, and/or apparatuses.
Figure 21:
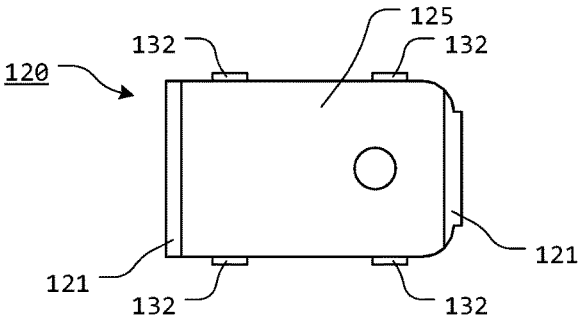
FIG. 21 illustrates a top view of an exemplary embodiment of a base plate insert, according to the presently disclosed systems, methods, and/or apparatuses.
Figure 22:
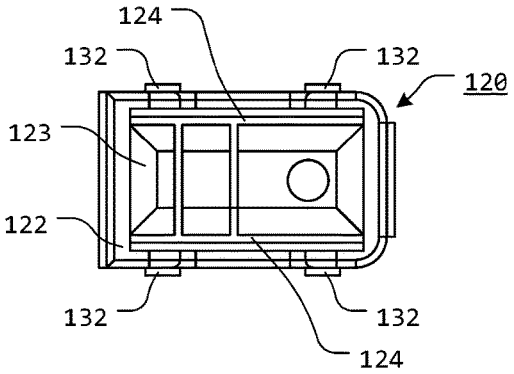
FIG. 22 illustrates a bottom view of an exemplary embodiment of a base plate insert, according to the presently disclosed systems, methods, and/or apparatuses.
Figure 23:
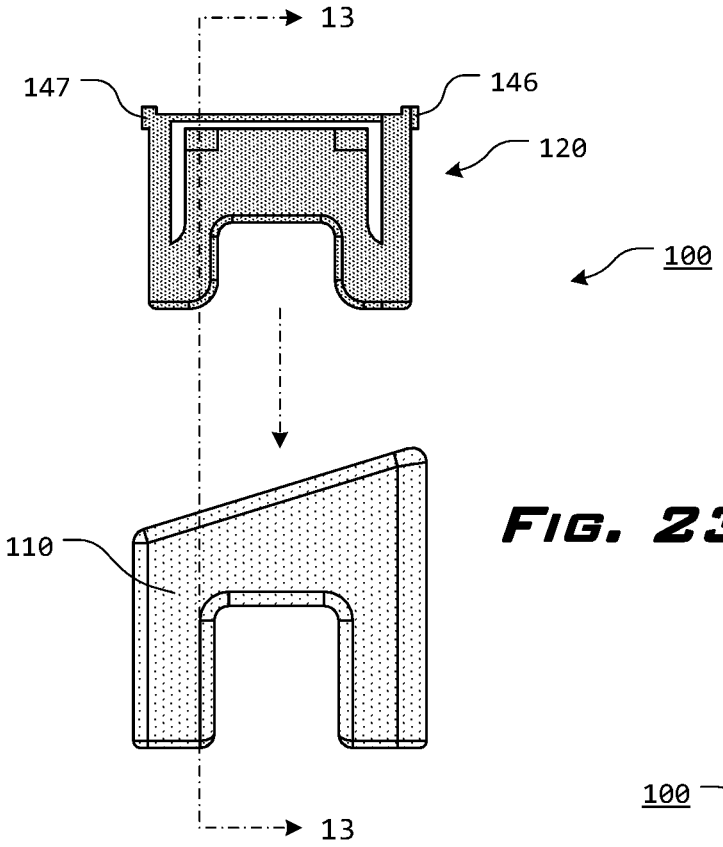
FIG. 23 illustrates a right side view of an exemplary embodiment of a base plate aligned with an exemplary embodiment of a base plate insert, according to the presently disclosed systems, methods, and/or apparatuses.
Figure 24:
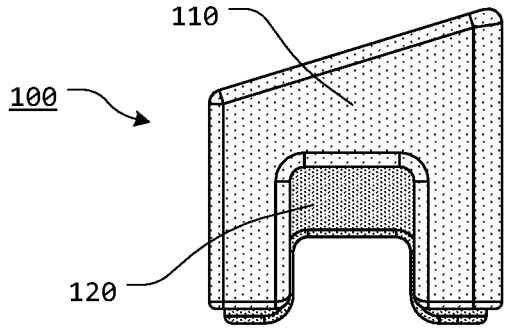
FIG. 24 illustrates a right side view of an exemplary embodiment of a base plate inserted within an exemplary embodiment of a base plate insert, wherein the base plate insert is in a retracted position according to the presently disclosed systems, methods, and/or apparatuses.
Figure 25:
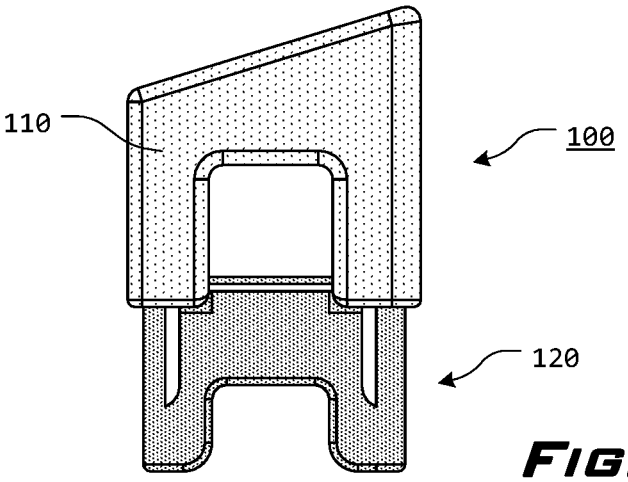
FIG. 25 illustrates a right side view of an exemplary embodiment of a base plate inserted within an exemplary embodiment of a base plate insert, wherein the base plate insert is in an extended position according to the presently disclosed systems, methods, and/or apparatuses.
Figure 26:
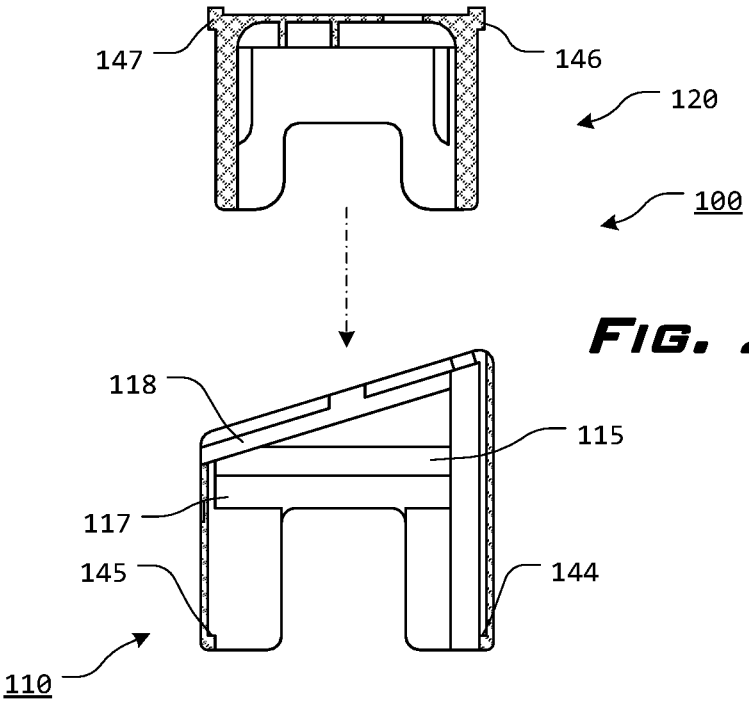
FIG. 26 illustrates a right side, cross-sectional view of an exemplary embodiment of a base plate aligned with an exemplary embodiment of a base plate insert, according to the presently disclosed systems, methods, and/or apparatuses.
Figure 27:
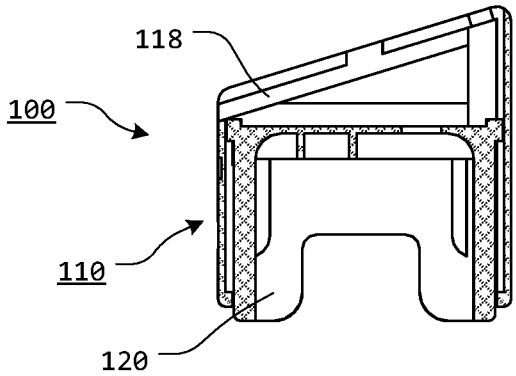
FIG. 27 illustrates a right side, cross-sectional view of an exemplary embodiment of a base plate inserted within an exemplary embodiment of a base plate insert, wherein the base plate insert is in a retracted position according to the presently disclosed systems, methods, and/or apparatuses.
Figure 28:
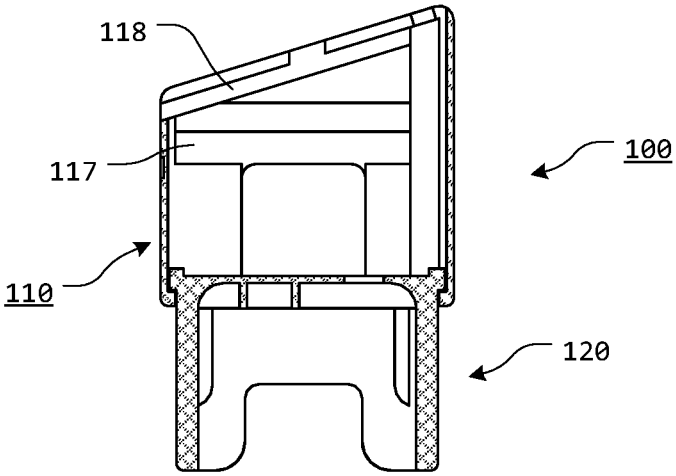
FIG. 28 illustrates a right side, cross-sectional view of an exemplary embodiment of a base plate inserted within an exemplary embodiment of a base plate insert, wherein the base plate insert is in an extended position according to the presently disclosed systems, methods, and/or apparatuses.
Figure 29:
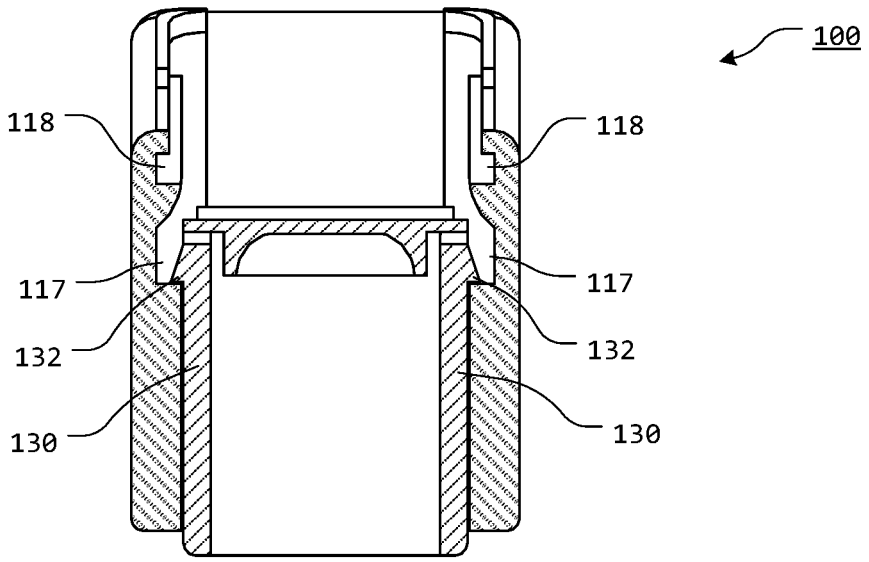
FIG. 29 illustrates a rear, cross-sectional view of an exemplary embodiment of a base plate inserted within an exemplary embodiment of a base plate insert, wherein the base plate insert is in a retracted position according to the presently disclosed systems, methods, and/or apparatuses.

In the extended position, as illustrated in FIGS. 2, 4, and 25, the outwardly extending projections 146 and 147 interact with the inwardly extending projections 144 and 145 to maintain the base plate insert 120 within the base plate passage 115.

To ease the cartridge loading process, the flexible tabs 130 on the base plate insert 120 are pressed inwardly by finger and thumb action. This releases the extending tabs 132 from the opposing channels 117. The tension from the magazine spring 20 urges the base plate insert 120 downwardly until the outwardly extending projections 146 and 147 interact with the inwardly extending projections 144 and 145 to retain the base plate insert 120 in the extended, lower position.

Advantageously, when the base plate insert 120 is in the extended position, the action causes further release of tension on the magazine spring 20, which will greatly ease the insertion of cartridges into the magazine body 13. The cartridges are then loaded into the magazine body 13 according to methods well known to the art. Once the capacity of cartridges in the magazine cavity 15 is achieved, the tension of the magazine spring 20 can be reactivated by urging the base plate insert 120 into the base plate body 113 until the extending tabs 132 interact with the opposing channels 117. At this point, the magazine assembly 10 and magazine base plate assembly 100 is ready for use in a firearm.

When in the extended position, cartridges are loaded into the magazine cavity 15, the magazine spring 20 extends at least partially from the magazine body 13. The spring biasing tension is then reduced from the magazine follower 30 and the user can place the remainder of the capacity of the cartridges without the typical tension applied by the magazine spring 20. Once the magazine body 13 is loaded with cartridges, the user can then force the base plate insert 120 up the magazine body 13 until the extending tabs 132 interact with opposing channels 117. This action forces the magazine spring 20 back into the magazine body 13, which in turn increasing the tension on the magazine spring 20. At this point, the magazine assembly 10 is in an activated state, i.e., ready for insertion into a firearm.

Another embodiment of the disclosure may optionally include no spring housing and just allow the magazine spring to extend until all cartridges or rounds loaded then the spring is force back into the magazine.

Another embodiment of the disclosure may optionally include a locking mechanism and no spring housing, but the magazine spring is released when wanted, then after it is forced back into the magazine it is locked in place while using the magazine.

Another embodiment of the disclosure may optionally include a telescoping design of the spring housing to even further decrease the spring tension.

The magazine assembly 10 of the present disclosure can be made with a metal or plastic spring housing (if needed), a metal or plastic base plate to the magazine custom made with a space for the spring housing or the spring to extend.

FIGS. 31-32, illustrate a cartridge or round magazine assembly 10' having and an attached or coupled magazine base plate assembly 100'. As illustrated, the magazine assembly 10' and the attached or coupled magazine base plate assembly 100' is intended for a rifle, such as an AR-15 carbine rifle. The magazine assembly 10' includes a magazine body 13', extending from a magazine top end 11'. The magazine base plate assembly 100' includes a base plate 110' and a base plate insert 120'.

It should be appreciated that each of these elements operates similarly to the base plate 110 and the base plate insert 120, as discussed above, with respect to the magazine base plate assembly 100. However, the magazine base plate assembly 100' is designed to be utilized in conjunction with a rifle-type magazine, as opposed to a pistol-type magazine.

FIGS. 33-59, illustrate an exemplary embodiment of a magazine base plate assembly 200, according to the present disclosure. It should be appreciated that the magazine base plate assembly 200 may be removably attached or coupled to the magazine bottom end 12, via interaction between the protruding edge 14 of the magazine body 13 and the magazine attachment channels 218 formed within each of the base plate opposing interior side walls 216 of the base plate 210. The base plate body 213 of the base plate 210 is preferably designed to slidably engage the magazine body 13 at the magazine bottom end 12 by engaging the protruding edge 14 of the magazine body 13 with the magazine attachment channels 218 positioned on the base plate opposing interior side walls 216 at the base plate upper end 211 of the base plate body 213. In this manner, the base plate 210 is attached or coupled to the magazine bottom end 12 in a manner similar to the attachment of a standard base plate to the magazine bottom end 12.

As illustrated in greater detail in FIGS. 33-40, the base plate 210 comprises at least some of a base plate body 213 extending from a base plate upper end 211 to a base plate lower end 212 and having an exterior base plate wall 214. The base plate body 213 further includes base plate opposing interior side walls 216, a base plate interior rear wall 209, and a base plate interior front wall 219, which at least partially define a base plate passage 215. The base plate passage 215 extends through the base plate 210 from the base plate upper end 211 through the base plate lower end 212.

Inwardly extending side wall projections 244 extend from each of the base plate opposing interior side walls 216, proximate the base plate lower end 212, into at least a portion of the base plate passage 215 and away from the base plate opposing interior side walls 216. Similarly, an inwardly extending rear wall projection 245 extends from the base plate interior rear wall 209, proximate the base plate lower end 212, into at least a portion of the base plate passage 215 and away from the base plate interior rear wall 209.

As discussed above, magazine attachment channels 218 are formed within at least a portion of each of the base plate opposing interior side walls 216. The magazine attachment channels 218 are formed so as to slidably interact with the protruding edge 14 of the magazine body 13 to attach or couple the base plate 210 to the magazine body 13. In certain exemplary, nonlimiting embodiments, securing tabs and/or securing recesses are formed so as to interact with at least a portion of the protruding edge 14 to further secure the base plate 210 to the magazine body 13. In these and similar exemplary embodiments, the base plate 210 can be removed from the magazine body 13 by pressing the securing tabs in an outward direction, and slidably removing the base plate 210 from the magazine body 13.

At least one base plate aperture 217 is formed through base plate body 213, within the exterior base plate wall 214. The base plate aperture 217 is formed such that at least a portion of the insert release button 250 may slidably extend therethrough. In various exemplary embodiments, a surface of the exterior base plate wall 214, surrounding the base plate aperture 217 may be at least partially recessed to aid in accessing or depressing a portion of the insert release button 250.

As illustrated in greater detail in FIGS. 41-50, the base plate insert 220 extends from an insert upper end 221 to an insert lower end 222 and includes opposing base plate insert side walls 227, a base plate insert front wall 228, and a base plate insert rear wall 229. A sidewall recess 232 is formed in each of the opposing base plate insert side walls 227. Each sidewall recess 232 is formed so as to extend from at least a portion of the insert lower end 222, toward the insert upper end 221, to a shoulder 237.

Similarly, a rear wall recess 231 is formed in the base plate insert rear wall 229. The rear wall recess 231 is formed so as to extend from at least a portion of the insert lower end 222, toward the insert upper end 221, to a shoulder 236.

An internal insert chamber 223 is formed within a portion of the base plate insert 220 and extends from the insert lower end 222, toward the insert upper end 221.

A base plate insert aperture 224 is formed through the base plate insert 220, within the base plate insert front wall 228. The base plate insert aperture 224 extends through the base plate insert front wall 228 and into the internal insert chamber 223. The base plate insert aperture 224 is formed such that at least a portion of the insert release button 250 may slidably extend therethrough.

A spring catch projection 226 is formed so as to extend within a portion of the internal insert chamber 223. The spring catch projection 226 is formed so as to allow an end portion of an insert release button biasing element 260 to be fitted about at least a portion of the spring catch projection 226, to assist in maintaining the insert release button biasing element 260 in a desired position within the internal insert chamber 223. The spring catch projection 226 is aligned with and formed opposite the base plate insert aperture 224.

In various exemplary embodiments, the insert release button biasing element 260 comprises a compressible coil spring. The insert release button biasing element 260 is selected to provide a biasing force to the insert release button 250 relative to the base plate insert 220. The insert release button biasing element 260 provides a biasing force to maintain the insert release button 250 in an engaged position, as illustrated most clearly in FIG. 54.

The base plate insert 220 is formed so as to be slidably positionable within at least a portion of the base plate passage 215 of the base plate body 213.

Figure 51:
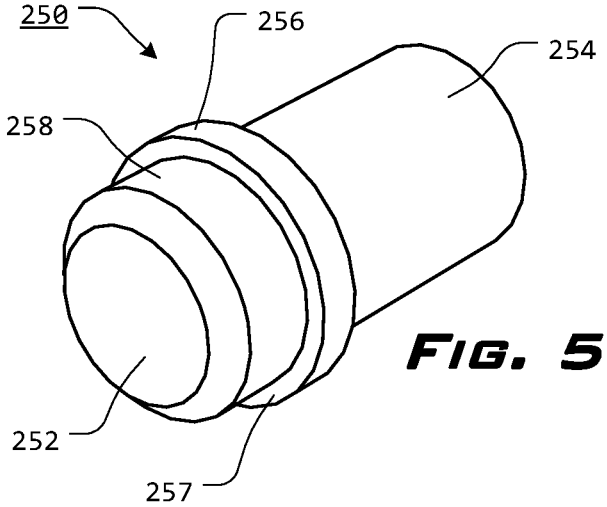
FIG. 51 illustrates an upper, rear, perspective view of an exemplary embodiment of an insert release button, according to the presently disclosed systems, methods, and/or apparatuses.
Figure 52:
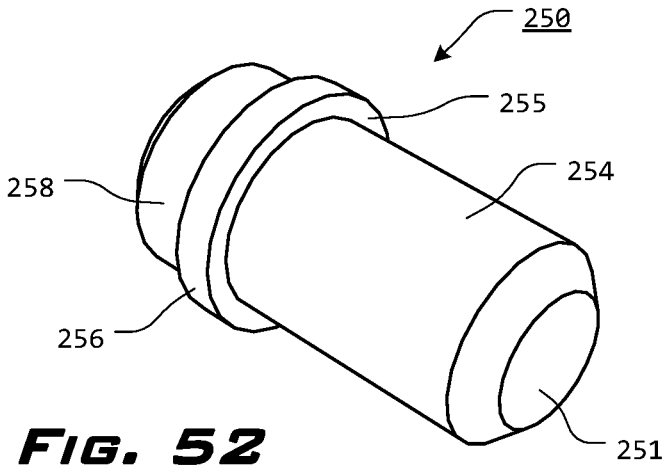
FIG. 52 illustrates an upper, front, perspective view of an exemplary embodiment of an insert release button, according to the presently disclosed systems, methods, and/or apparatuses.
Figure 53:
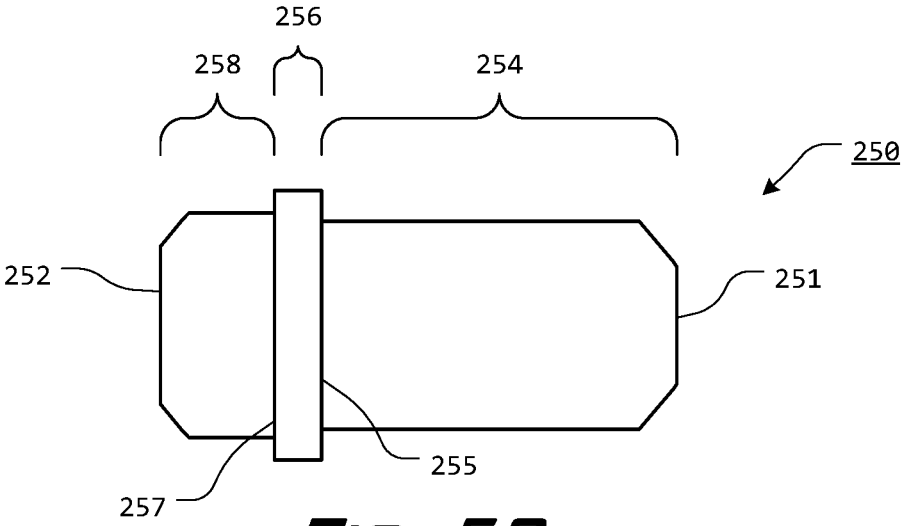
FIG. 53 illustrates a side view of an exemplary embodiment of an insert release button, according to the presently disclosed systems, methods, and/or apparatuses.

As illustrated in greater detail in FIGS. 51-53, the insert release button 250 extends from an insert release button first end 251, along a substantially cylindrical first portion 254, to an extension portion 256. The insert release button 250 then extends from the extension portion 256, along a substantially cylindrical second portion 258, to an insert release button second end 252.

A first shoulder 255 extends from an exterior surface of the substantially cylindrical first portion 254 to an exterior surface of the extension portion 256 and a second shoulder 257 extends from the exterior surface of the extension portion 256 to an exterior surface of the substantially cylindrical second portion 258.

An outer diameter of the extension portion 256 is greater than an outer diameter of the first portion 254 and an outer diameter of the second portion 258. In various exemplary embodiments, the outer diameter of the second portion 258 is greater than the outer diameter of the first portion 254.

The outer diameter of the first portion 254 is such that the outer diameter of the first portion 254 is equal to or less than the inner diameter of the base plate insert aperture 224 and the base plate aperture 217. In this manner, at least a portion of the first portion 254 is repeatably slidable within the base plate insert aperture 224 and the base plate aperture 217. The outer diameter of the extension portion 256 is greater than the inner diameter of the base plate insert aperture 224. Thus, when a portion of the first portion 254 is positioned through the base plate insert aperture 224, the first portion 254 is slidable within the base plate insert aperture 224 such that slidable movement of the insert release button 250 is limited by interaction between the second shoulder 257 and the interior side wall of the internal insert chamber 223 proximate the base plate insert aperture 224.

The substantially cylindrical second portion 258 is formed so as to allow an end portion of the insert release button biasing element 260 to be fitted about at least a portion of the substantially cylindrical second portion 258, to assist in maintaining the insert release button biasing element 260 in a desired position within the internal insert chamber 223.

FIGS. 54-59, illustrate various aspects of the installation and usage of the magazine base plate assembly 200. During initial assembly of the components of the magazine base plate assembly 200, the insert release button 250 is positioned within the internal insert chamber 223 and the insert release button first end 251 is positioned through the base plate insert aperture 224 such that at least a portion of the first portion 254 is positioned through the base plate insert aperture 224 to extend from the base plate insert front wall 228.

A first end portion of the insert release button biasing element 260 is fitted about at least a portion of the spring catch projection 226, while the a second end portion of the insert release button biasing element 260 is fitted about at least a portion of the substantially cylindrical second portion 258 and abutted against the second shoulder 257 of the insert release button 250. Once assembled, the insert release button biasing element 260 provides a biasing force to maintain the insert release button 250 in the engaged position.

During initial installation of the base plate insert 220 into the base plate 210, the base plate insert 220 is initially aligned with the base plate passage 215 and inserted, from the base plate upper end 211, into the base plate passage 215. The sidewall recesses 232 are aligned with the inwardly extending side wall projections 244 and the rear wall recess 231 is aligned with the inwardly extending rear wall projection 245.

As the base plate insert 220 is urged further within the base plate passage 215, the insert release button 250 reaches the base plate upper end 211 of the base plate passage 215. When the insert release button 250 reaches the base plate upper end 211 of the base plate passage 215, the insert release button 250 is urged toward the disengaged position a sufficient distance to allow the base plate insert 220 to be urged further within the base plate passage 215, toward the base plate lower end 212.

Figure 54:
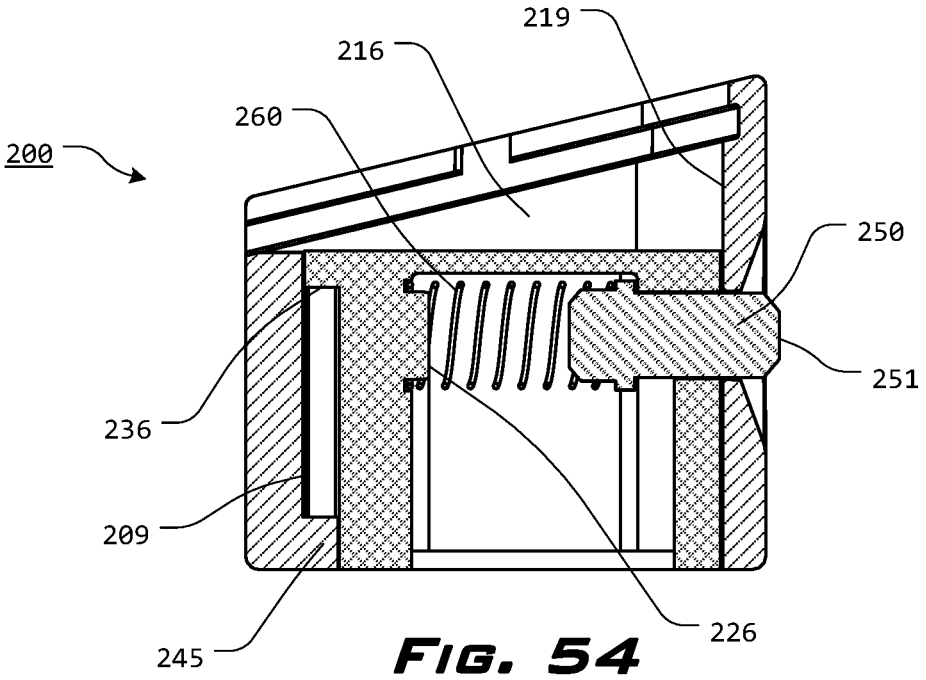
FIG. 54 illustrates a left side, cross-sectional view of an exemplary embodiment of a base plate inserted within an exemplary embodiment of a base plate insert, wherein the base plate insert is in a retracted position and the insert release button is in an engaged position according to the presently disclosed systems, methods, and/or apparatuses.

The base plate insert 220 is urged further within the base plate passage 215, toward the base plate lower end 212, until the insert release button first end 251 of the insert release button 250 reaches the base plate aperture 217. When the insert release button 250 reaches the base plate aperture 217, the bias of the insert release button biasing element 260 urges the insert release button 250 toward the engaged position and at least a portion of the first portion 254 is urged through the base plate aperture 217 a sufficient distance to allow the base plate insert 220 to be maintained in a retracted position within the base plate passage 215, as illustrated in FIG. 54.

Once the magazine base plate assembly 200 is assembled, the magazine base plate assembly 200 can be attached or coupled to a magazine assembly 10, substantially as described herein, such that the magazine spring 20 is tension mounted within the magazine body 13, thereby exerting biasing tension to the magazine follower 30 and the insert upper end 221 of the base plate insert 220 (optionally via a magazine lock plate 40). With a portion of the insert release button 250 within the base plate aperture 217, the magazine base plate assembly 200 is maintained in the retracted position. In the retracted position, as illustrated in FIG. 54, a portion of the insert release button 250 interacts with base plate insert aperture 224 and the base plate aperture 217.

Figure 55:
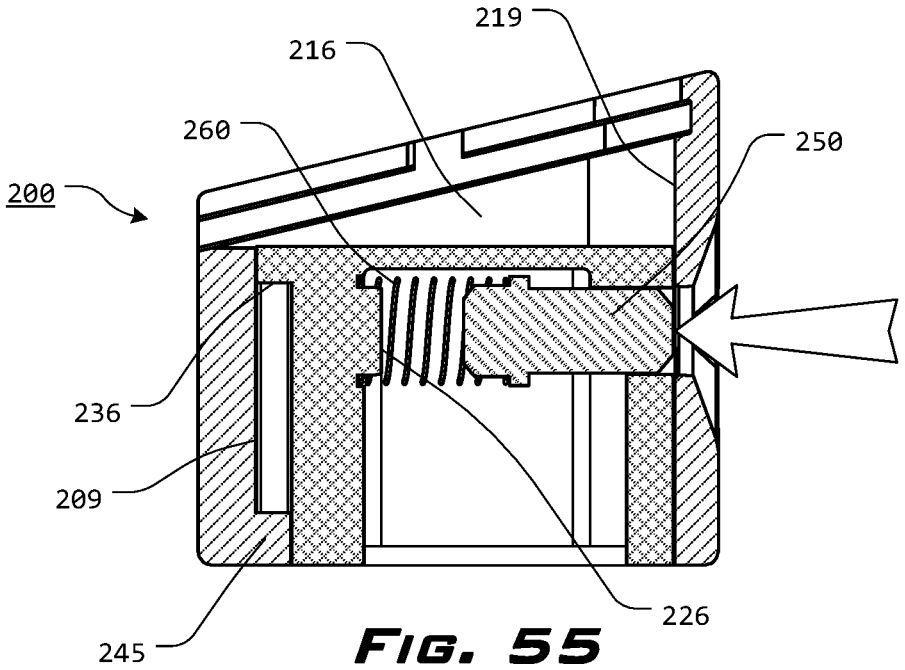
FIG. 55 illustrates a left side, cross-sectional view of an exemplary embodiment of a base plate inserted within an exemplary embodiment of a base plate insert, wherein the base plate insert is in a retracted position and the insert release button is in a disengaged position according to the presently disclosed systems, methods, and/or apparatuses.
Figure 56:
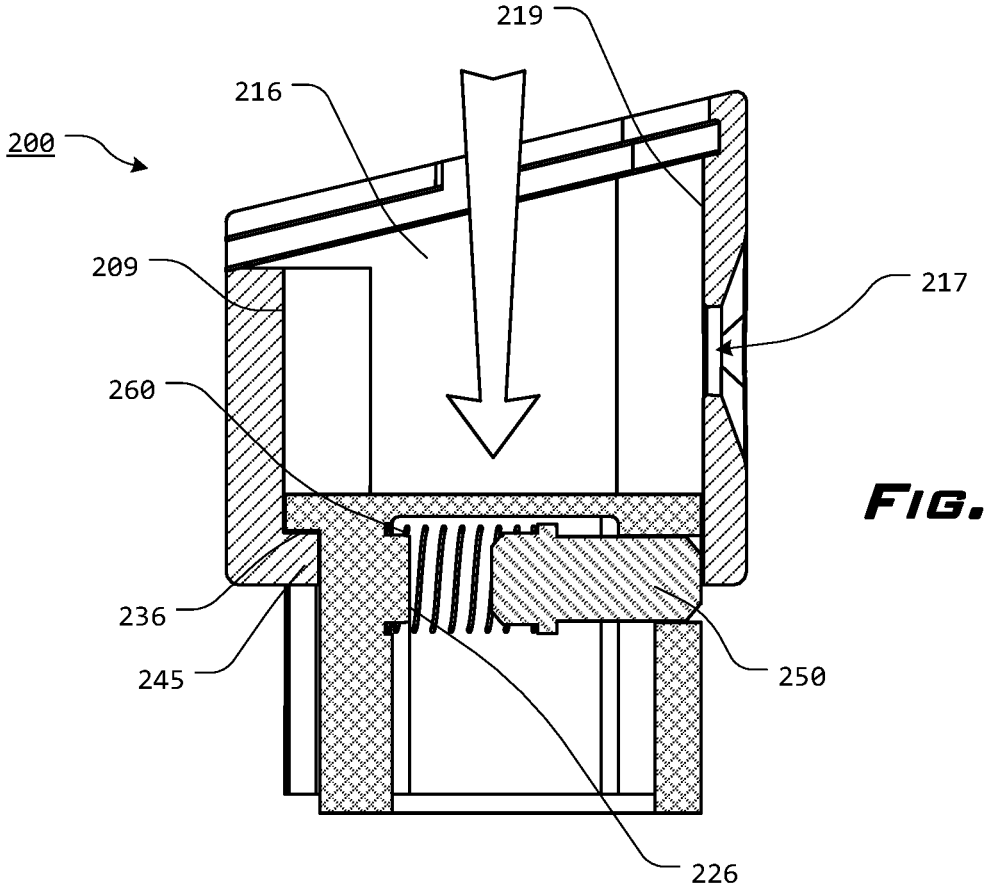
FIG. 56 illustrates a left side, cross-sectional view of an exemplary embodiment of a base plate inserted within an exemplary embodiment of a base plate insert, wherein the base plate insert is in an extended position according to the presently disclosed systems, methods, and/or apparatuses.
Figure 57:
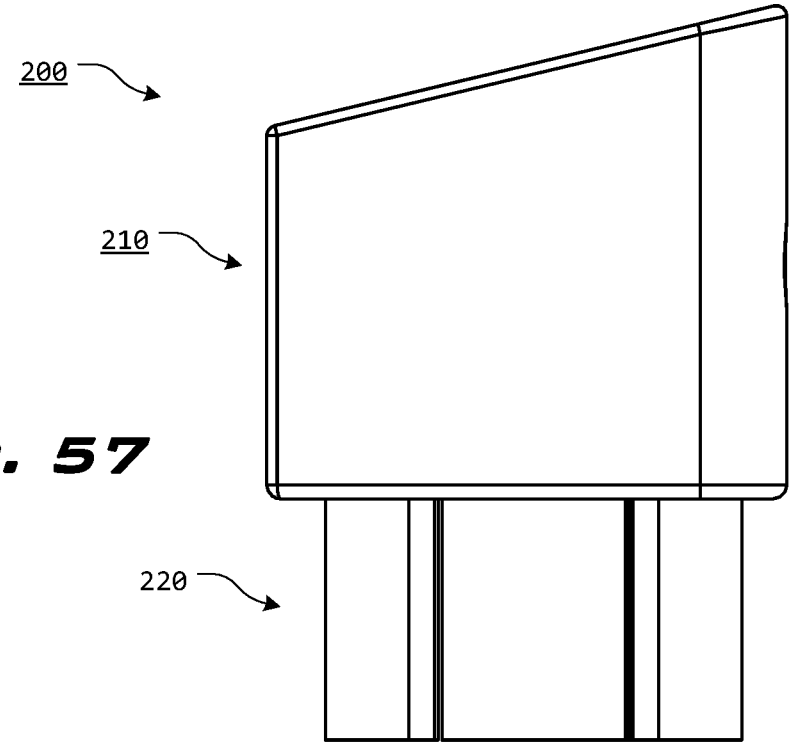
FIG. 57 illustrates a left side view of an exemplary embodiment of a base plate inserted within an exemplary embodiment of a base plate insert, wherein the base plate insert is in an extended position according to the presently disclosed systems, methods, and/or apparatuses.
Figure 58:
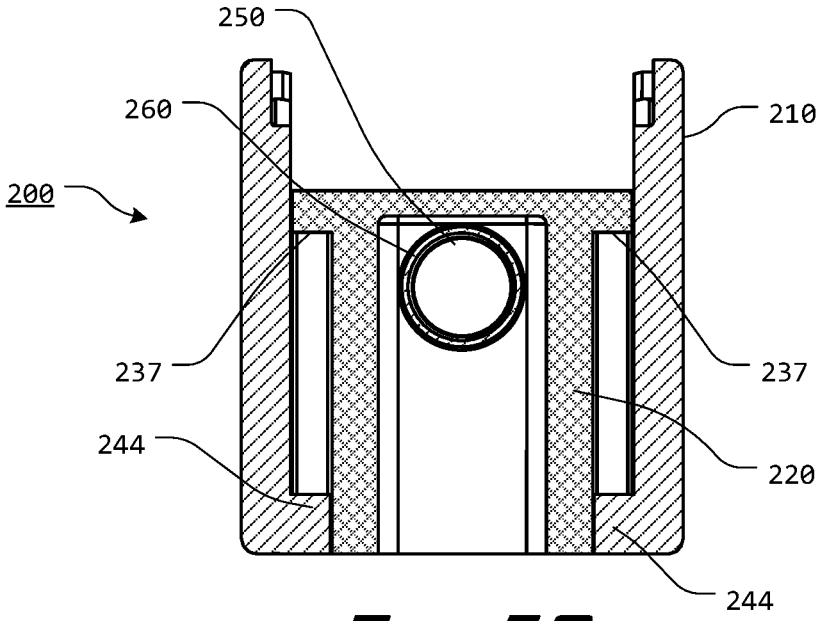
FIG. 58 illustrates a front, cross-sectional view of an exemplary embodiment of a base plate inserted within an exemplary embodiment of a base plate insert, wherein the base plate insert is in a retracted position according to the presently disclosed systems, methods, and/or apparatuses.
Figure 59:
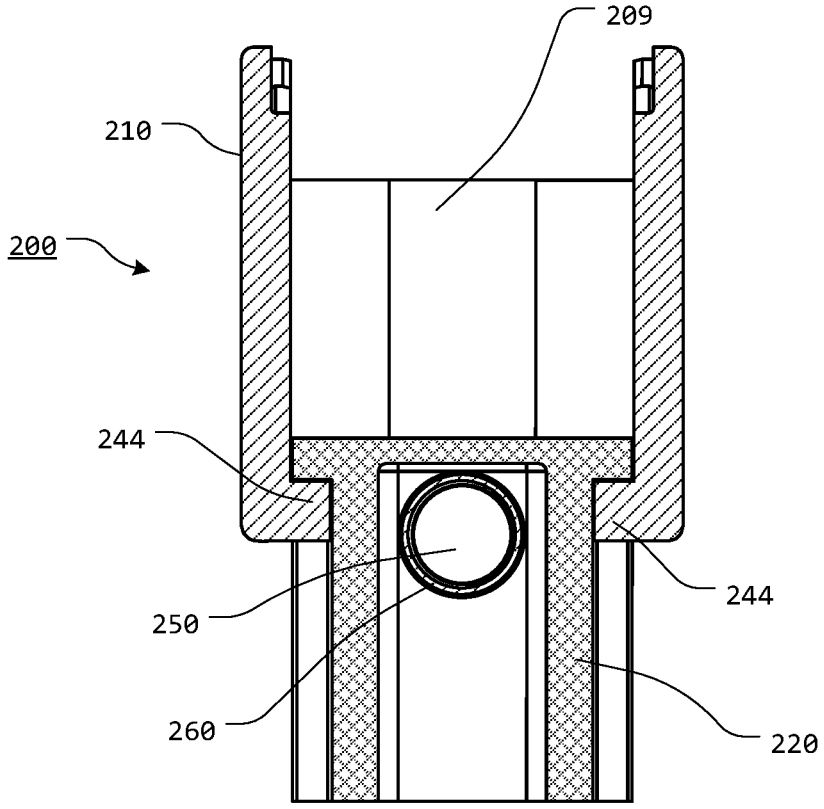
FIG. 59 illustrates a front, cross-sectional view of an exemplary embodiment of a base plate inserted within an exemplary embodiment of a base plate insert, wherein the base plate insert is in an extended position according to the presently disclosed systems, methods, and/or apparatuses.

To move the magazine base plate assembly 200 from the retracted position to the extended position, the insert release button 250 is urged toward the base plate insert 220 (toward the disengaged position), such that the insert release button 250 is urged from or withdrawn from the base plate aperture 217. As illustrated in FIGS. 55-57, when the insert release button 250 is urged from or withdrawn from the base plate aperture 217, the base plate insert 220 is able to move, within the base plate passage 215, toward the extended position.

In the extended position, as illustrated in FIGS. 56 and 57, the inwardly extending side wall projections 244 interact with the sidewall recess 232 and the inwardly extending rear wall projection 245 interacts with the rear wall recess 231 to maintain the base plate insert 220 within the base plate passage 215. The furthest extent of the extended position is achieved when the shoulders 237 of the sidewall recesses 232 contact a respective shoulder of the inwardly extending side wall projections 244 and/or the shoulder 236 of the rear wall recess 231 contacts a shoulder of the inwardly extending rear wall projection 245.

To ease the cartridge loading process, the insert release button 250 on the base plate insert 220 is pressed inwardly. This releases the insert release button 250 from the base plate aperture 217. The tension from the magazine spring 20 urges the base plate insert 220 downwardly until the shoulders 237 of the sidewall recesses 232 contact a respective shoulder of the inwardly extending side wall projections 244 and/or the shoulder 236 of the rear wall recess 231 contacts a shoulder of the inwardly extending rear wall projection 245 to retain the base plate insert 220 in the extended, lower position.

Advantageously, when the base plate insert 220 is in the extended position, the action causes further release of tension on the magazine spring 20, which will greatly ease the insertion of cartridges into the magazine body 13. The cartridges are then loaded into the magazine body 13 according to methods well known to the art. Once the capacity of cartridges in the magazine cavity 15 is achieved, the tension of the magazine spring 20 can be reactivated by urging the base plate insert 220 into the base plate body 213 until the insert release button 250 interacts with the base plate aperture 217 and the base plate insert 220 is again in the retracted position. Once the base plate insert 220 is in the retracted position, the magazine assembly 10 and magazine base plate assembly 200 is ready for use in a firearm.

While the presently disclosed systems, methods, and/or apparatuses has been described in conjunction with the exemplary embodiments outlined above, the foregoing description of exemplary embodiments of the presently disclosed systems, methods, and/or apparatuses, as set forth above, are intended to be illustrative, not limiting and the fundamental disclosed systems, methods, and/or apparatuses should not be considered to be necessarily so constrained. It is evident that the presently disclosed systems, methods, and/or apparatuses is not limited to the particular variation set forth and many alternatives, adaptations modifications, and/or variations will be apparent to those skilled in the art.

Furthermore, where a range of values is provided, it is understood that every intervening value, between the upper end lower limit of that range and any other stated or intervening value in that stated range is encompassed within the presently disclosed systems, methods, and/or apparatuses. The upper end lower limits of these smaller ranges may independently be included in the smaller ranges and is also encompassed within the presently disclosed systems, methods, and/or apparatuses, subject to any specifically excluded limit in the stated range. Where the stated range includes one or both of the limits, ranges excluding either or both of those included limits are also included in the presently disclosed systems, methods, and/or apparatuses.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the presently disclosed systems, methods, and/or apparatuses and elements or methods similar or equivalent to those described herein can be used in practicing the presently disclosed systems, methods, and/or apparatuses. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A magazine assembly, comprising:

a magazine body having a magazine top end and a magazine bottom end and a magazine cavity extending from said magazine top end to said magazine bottom end;

a base plate releasably attached or coupled to said magazine bottom end of said magazine body, wherein said base plate includes a base plate body having a base plate front wall, a base plate rear wall, and base plate opposing side walls, wherein said base plate includes a base plate passage defined by base plate opposing interior side walls, a base plate interior front wall, and a base plate interior rear wall, and wherein a base plate aperture is formed through said base plate body, from said base plate passage through said base plate front wall;

a base plate insert, wherein said base plate insert includes a base plate insert front wall, a base plate insert rear wall, and base plate insert opposing side walls, wherein said base plate insert is slidably positioned within at least a portion of said base plate passage and is repeatably slidable between a retracted position and an extended position within at least a portion of said base plate passage, wherein an internal insert chamber is formed within a portion of said base plate insert, which extends from a base plate insert lower end, toward a base plate insert upper end, wherein a base plate insert aperture is formed through said base plate insert, wherein said base plate insert aperture extends from said internal insert chamber through said base plate insert front wall, and wherein in said retracted position said base plate insert aperture is aligned with at least a portion of said base plate aperture; and an insert release button, wherein said insert release button extends from an insert release button first end, along a first portion, to an extension portion and from said extension portion, along a second portion, to an insert release button second end, wherein said insert release button is positioned at least partially within said internal insert chamber such that at least a portion of said first portion is positioned through said base plate insert aperture and wherein said insert release button is repeatably slidable between an engaged position and a disengaged position, wherein if said base plate insert is in said retracted position and said insert release button is in said engaged position, at least a portion of said first portion of said insert release button extends through said base plate insert aperture and into at least a portion of said base plate aperture, and wherein said insert release button is biased to said engaged position via an insert release button biasing element, wherein a first end portion of said insert release button biasing element is fitted about at least a portion of a spring catch projection formed within a portion of said internal insert chamber and a second end portion of said insert release button biasing element is fitted about at least a portion of said second portion of said insert release button.

2. The magazine assembly of claim 1, wherein said first portion of said insert release button is a substantially cylindrical first portion and wherein said second portion of said insert release button is a substantially cylindrical second portion.

3. The magazine assembly of claim 1, wherein in said disengaged position, at least a portion of said first portion of said insert release button is withdrawn from said base plate aperture and said base plate insert is slidable toward said extended position.

4. The magazine assembly of claim 1, wherein a first shoulder extends from an exterior surface of said first portion of said insert release button to an exterior surface of said extension portion and wherein a second shoulder extends from said exterior surface of said extension portion of said insert release button to an exterior surface of said second portion.

5. The magazine assembly of claim 1, wherein a lock plate recess is formed in said insert upper end so as to interact with at least a portion of a magazine lock plate to maintain said magazine lock plate in a desired position relative to said magazine cavity if said base plate is attached or coupled to said magazine body.

6. The magazine assembly of claim 5, wherein a portion of said magazine lock plate is positioned atop a portion of an upper surface of said base plate insert.

7. The magazine assembly of claim 1, wherein an inwardly extending side wall projection extends from each of said base plate opposing interior side walls, into at least a portion of said base plate passage, wherein an inwardly extending rear wall projection extends from said base plate interior rear wall, into at least a portion of said base plate passage, wherein a sidewall recess is formed in each of said opposing base plate insert side walls, wherein each sidewall recess extends from at least a portion of an insert lower end of said base plate insert, toward an insert upper end of said base plate insert, wherein a base plate insert rear wall recess is formed in said base plate insert rear wall, wherein said base plate insert rear wall recess extends from at least a portion of said insert lower end of said base plate insert, toward said insert upper end of said base plate insert, wherein each inwardly extending side wall projection is alignable within at least a portion of a respective sidewall recess, and wherein said inwardly extending rear wall projection is alignable within at least a portion of said base plate insert rear wall recess.

8. The magazine assembly of claim 7, wherein interaction between each inwardly extending side wall projection and a portion of a respective sidewall recess and/or interaction between said inwardly extending rear wall projection and a portion of said base plate insert rear wall recess limits slidable movement of said base plate insert within said base plate passage of said base plate body.

9. The magazine assembly of claim 1, further comprising a magazine spring having a spring top end and a spring bottom end, wherein said magazine spring is positioned within said magazine cavity, and wherein said magazine spring contacts at least a portion of a magazine follower at said spring top end.

10. The magazine assembly of claim 9, wherein a degree of tension provided by said magazine spring is reduced when said base plate insert is in said extended position.

11. A magazine base plate assembly, comprising:

a base plate, wherein said base plate includes a base plate body having a base plate front wall, a base plate rear wall, and base plate opposing side walls, wherein said base plate includes a base plate passage defined by base plate opposing interior side walls, a base plate interior front wall, and a base plate interior rear wall, and wherein a base plate aperture is formed through said base plate body, from said base plate passage through said base plate front wall;

a base plate insert, wherein said base plate insert includes a base plate insert front wall, a base plate insert rear wall, and base plate insert opposing side walls, wherein said base plate insert is slidably positioned within at least a portion of said base plate passage and is repeatably slidable between a retracted position and an extended position within at least a portion of said base plate passage, wherein an internal insert chamber is formed within a portion of said base plate insert, which extends from a base plate insert lower end, toward a base plate insert upper end, wherein a base plate insert aperture is formed through said base plate insert, wherein said base plate insert aperture extends from said internal insert chamber through said base plate insert front wall, and wherein in said retracted position said base plate insert aperture is aligned with at least a portion of said base plate aperture; and an insert release button, wherein said insert release button extends from an insert release button first end, along a first portion, to an extension portion and from said extension portion, along a second portion, to an insert release button second end, wherein said insert release button is positioned at least partially within said internal insert chamber such that at least a portion of said first portion is positioned through said base plate insert aperture and wherein said insert release button is repeatably slidable between an engaged position and a disengaged position, wherein if said base plate insert is in said retracted position and said insert release button is in said engaged position, at least a portion of said first portion of said insert release button extends through said base plate insert aperture and into at least a portion of said base plate aperture, and wherein said insert release button is biased to said engaged position via an insert release button biasing element, wherein a first end portion of said insert release button biasing element is fitted about at least a portion of a spring catch projection formed within a portion of said internal insert chamber and a second end portion of said insert release button biasing element is fitted about at least a portion of said second portion of said insert release button.

12. The magazine assembly of claim 11, wherein in said disengaged position, at least a portion of said first portion of said insert release button is withdrawn from said base plate aperture and said base plate insert is slidable toward said extended position.

13. The magazine assembly of claim 11, wherein a first shoulder extends from an exterior surface of said first portion of said insert release button to an exterior surface of said extension portion and wherein a second shoulder extends from said exterior surface of said extension portion of said insert release button to an exterior surface of said second portion.

14. The magazine assembly of claim 11, wherein said first portion of said insert release button is a substantially cylindrical first portion and wherein said second portion of said insert release button is a substantially cylindrical second portion.

15. The magazine assembly of claim 11, further comprising a magazine spring having a spring top end and a spring bottom end, wherein said magazine spring is positioned within said magazine cavity, and wherein said magazine spring contacts at least a portion of a magazine follower at said spring top end, wherein a degree of tension provided by said magazine spring is reduced when said base plate insert is in said extended position.

16. The magazine assembly of claim 11, wherein an inwardly extending side wall projection extends from each of said base plate opposing interior side walls, into at least a portion of said base plate passage, wherein an inwardly extending rear wall projection extends from said base plate interior rear wall, into at least a portion of said base plate passage, wherein a sidewall recess is formed in each of said opposing base plate insert side walls, wherein each sidewall recess extends from at least a portion of an insert lower end of said base plate insert, toward an insert upper end of said base plate insert, wherein a base plate insert rear wall recess is formed in said base plate insert rear wall, wherein said base plate insert rear wall recess extends from at least a portion of said insert lower end of said base plate insert, toward said insert upper end of said base plate insert, wherein each inwardly extending side wall projection is alignable within at least a portion of a respective sidewall recess, and wherein said inwardly extending rear wall projection is alignable within at least a portion of said base plate insert rear wall recess.

17. The magazine assembly of claim 16, wherein interaction between each inwardly extending side wall projection and a portion of a respective sidewall recess and/or interaction between said inwardly extending rear wall projection and a portion of said base plate insert rear wall recess limits slidable movement of said base plate insert within said base plate passage of said base plate body.

18. A magazine base plate assembly, comprising:

a base plate, wherein said base plate includes a base plate passage defined within a portion of said base plate, and wherein a base plate aperture is formed through said base plate, from said base plate passage through a base plate front wall of said base plate;

a base plate insert, wherein said base plate insert is slidably positioned within at least a portion of said base plate passage and is repeatably slidable between a retracted position and an extended position within at least a portion of said base plate passage, wherein an internal insert chamber is formed within a portion of said base plate insert, wherein a base plate insert aperture is formed through said base plate insert, wherein said base plate insert aperture extends from said internal insert chamber through a base plate insert front wall of said base plate insert, and wherein in said retracted position said base plate insert aperture is aligned with at least a portion of said base plate aperture; and an insert release button, wherein a portion of said insert release button is positioned at least partially within said internal insert chamber such that at least a portion of said insert release button is positioned through said base plate insert aperture and wherein said insert release button is repeatably slidable between an engaged position and a disengaged position, wherein if said base plate insert is in said retracted position and said insert release button is in said engaged position, at least a portion of said insert release button extends through said base plate insert aperture and into at least a portion of said base plate aperture, and wherein said insert release button is biased to said engaged position via an insert release button biasing element, wherein a first end portion of said insert release button biasing element is fitted about at least a portion of a spring catch projection formed within a portion of said internal insert chamber and a second end portion of said insert release button biasing element is fitted about at least a portion of said second portion of said insert release button.

19. The magazine assembly of claim 18, wherein in said disengaged position, at least a portion of said first portion of said insert release button is withdrawn from said base plate aperture and said base plate insert is slidable toward said extended position.

20. The magazine assembly of claim 18, wherein said wherein said first portion of said insert release button is a substantially cylindrical first portion and wherein said second portion of said insert release button is a substantially cylindrical second portion.

* * * * *